US009022388B2

(12) United States Patent
Nonaka

(10) Patent No.: US 9,022,388 B2
(45) Date of Patent: May 5, 2015

(54) SHEET STACKING SYSTEM AND METHOD OF CONTROLLING THE SAME, AND STORAGE MEDIUM

(71) Applicant: Canon Kabushiki Kaisha, Tokyo (JP)

(72) Inventor: Takashi Nonaka, Kunitachi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/066,031

(22) Filed: Oct. 29, 2013

(65) Prior Publication Data

US 2014/0159306 A1 Jun. 12, 2014

(30) Foreign Application Priority Data

Dec. 7, 2012 (JP) ..... 2012-268808

(51) Int. Cl.

| | |
|---|---|
| ***B65H 31/32*** | (2006.01) |
| ***B65H 7/20*** | (2006.01) |
| ***B65H 31/24*** | (2006.01) |
| ***B65H 29/60*** | (2006.01) |
| ***B65H 31/10*** | (2006.01) |
| ***B65H 31/30*** | (2006.01) |
| ***B65H 43/06*** | (2006.01) |
| ***G03G 15/00*** | (2006.01) |

(52) U.S. Cl.

CPC ..... *B65H 7/20* (2013.01); *B65H 31/24* (2013.01); *B65H 29/60* (2013.01); *B65H 31/10* (2013.01); *B65H 31/3063* (2013.01); *B65H 43/06* (2013.01); *G03G 15/6552* (2013.01); *B65H 2405/15* (2013.01); *B65H 2801/27* (2013.01); *G03G 2215/00421* (2013.01); *G03G 2221/1696* (2013.01)

(58) Field of Classification Search

CPC ..... B65H 31/22; B65H 31/32; B65H 31/24; B65H 31/26

USPC ..... 271/288, 289, 290

See application file for complete search history.

(56) References Cited

U.S. PATENT DOCUMENTS

| | | | | |
|---|---|---|---|---|
| 8,657,286 | B2 * | 2/2014 | Ishikawa et al. | 271/288 |
| 2007/0171455 | A1 * | 7/2007 | Tominaga | 358/1.14 |
| 2008/0042342 | A1 * | 2/2008 | Tominaga et al. | 271/298 |

FOREIGN PATENT DOCUMENTS

JP 2009-269303 A 11/2009

* cited by examiner

*Primary Examiner* — Michael McCullough
*Assistant Examiner* — Howard Sanders
(74) *Attorney, Agent, or Firm* — Fitzpatrick, Cella, Harper & Scinto

(57) ABSTRACT

The sheet stacking system discharges a sheet to one of a first stacking apparatus including a first stacking tray and a second stacking tray, and a second stacking apparatus including a third stacking tray, executes one of a first discharging method and a second discharging method, the first discharging method for moving, after a sheet is discharged to the first stacking tray by executing a job, the sheet which has been discharged to the first stacking tray to the second sheet stacking tray and discharging a sheet to the first stacking tray of the first stacking apparatus by executing the job, and the second discharging method for, after a sheet is discharged to the first stacking tray by executing the job, discharging a sheet to the third stacking tray of the second stacking apparatus by executing the job.

11 Claims, 17 Drawing Sheets

SHEET STACKING SYSTEM AND METHOD OF CONTROLLING THE SAME, AND STORAGE MEDIUM

BACKGROUND OF THE INVENTION

1. Field of the Invention

The present invention relates to a sheet stacking system, a method of controlling the same, and a storage medium.

2. Description of the Related Art

In a system including a printing apparatus and a post processing apparatus for executing post processing for sheets printed by the printing apparatus, it is important to efficiently and accurately process a large volume of materials printed by the printing apparatus. In particular, a situation in which the printing speed of the printing apparatus drops under the influence of the operation of the post processing apparatus should be avoided. A work process should be designed to prevent generation of a work error in processing a printed material by an operator.

Japanese Patent Laid-Open No. 2009-269303 discloses a technique in which, when an instruction is input during print processing by a printing apparatus to take out printed sheets stored in a large-volume stacker serving as an example of a post processing apparatus, the discharge destination of sheets to be discharged from the printing apparatus is changed to another place. Even when taking out printed sheets from the stacker, the print operation can continue without interrupting the print processing by the printing apparatus.

A large-volume stacker includes a lift table which receives and stacks printed sheets discharged from the printing apparatus and can move up and down depending on the state of the stacked sheet bundle. To eject a sheet bundle stacked on the lift table from the stacker, some large-volume stackers are equipped with an ejection table which receives the sheet bundle from the lift table so that the user can take it out from the stacker. When the lift table becomes full of sheets discharged from the printing apparatus or sheets are stacked to a predetermined height on the lift table, the large-volume stacker reloads the sheet bundle on the lift table to the ejection table so that the sheet bundle can be taken out from the stacker. The large-volume stacker returns the blank lift table to the original position where the lift table can receive and stack sheets discharged from the printing apparatus. The large-volume stacker then continues the operation of stacking sheets discharged from the printing apparatus on the lift table. However, a time of several tens of seconds is taken to reload a sheet bundle from the lift table to the ejection table. Meanwhile, the large-volume stacker cannot receive sheets discharged from the printing apparatus. Thus, the printing apparatus temporarily interrupts the print operation, decreasing the productivity.

To prevent the decrease in productivity caused by interruption of print processing by the printing apparatus when printed sheets are taken out from the stacker, a plurality of large-volume stackers may be connected to the printing apparatus. In this case, while the first large-volume stacker executes the operation of reloading a sheet bundle to the ejection table when the lift table becomes full, subsequent printed sheets discharged from the printing apparatus are stacked on the lift table of the second large-volume stacker. By performing this operation, the printing apparatus can continuously execute the print operation, preventing generation of the above-described situation in which the productivity decreases. This operation is advantageous in terms of the productivity.

It is also important to prevent generation of a work error as much as possible when the operator processes printed sheets. The sheet process by the operator is, for example, work of carrying a sheet bundle stacked on the large-volume stacker to the next post processing apparatus. When a plurality of large-volume stackers are used, the operator needs to do work by always being aware of a large-volume stacker to which target printed sheets are discharged. When the lift table of one stacker becomes full and the discharge destination of printed sheets is automatically switched to another stacker, as described above, it becomes difficult for the operator to grasp the order of sheets.

As described above, there are two challenges to perform the print operation for a large volume of sheets without decreasing the productivity and to clarify work by an operator who processes a large volume of printed sheets.

SUMMARY OF THE INVENTION

An aspect of the present invention is to eliminate the above-mentioned problems which are found in the conventional techniques.

A feature of the present invention is to provide a technique which allows the operator to set either a mode in which priority is given to print processing in a printing apparatus or a mode in which priority is given to work by the operator.

According to an aspect of the present invention, there is provided a sheet stacking system comprising: a discharge unit configured to discharge a sheet to one of a first stacking apparatus including a first stacking tray and a second stacking tray, and a second stacking apparatus including a third stacking tray; a control unit configured to execute one of a first discharging method and a second discharging method, the first discharging method for moving, after a sheet is discharged to the first stacking tray by executing a job, the sheet which has been discharged to the first stacking tray to the second sheet stacking tray and discharging a sheet to the first stacking tray of the first stacking apparatus by executing the job, and the second discharging method for, after a sheet is discharged to the first stacking tray by executing the job, discharging a sheet to the third stacking tray of the second stacking apparatus by executing the job.

According to an aspect of the present invention, there is provided a method of controlling a sheet stacking system, the method comprising: discharging a sheet to one of a first stacking apparatus including a first stacking tray and a second stacking tray, and a second stacking apparatus including a third stacking tray; executing one of a first discharging method and a second discharging method, the first discharging method for moving, after a sheet is discharged to the first stacking tray by executing a job, the sheet which has been discharged to the first stacking tray to the second sheet stacking tray and discharging a sheet to the first stacking tray of the first stacking apparatus by executing the job, and the second discharging method for, after a sheet is discharged to the first stacking tray by executing the job, discharging a sheet to the third stacking tray of the second stacking apparatus by executing the job.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1A:
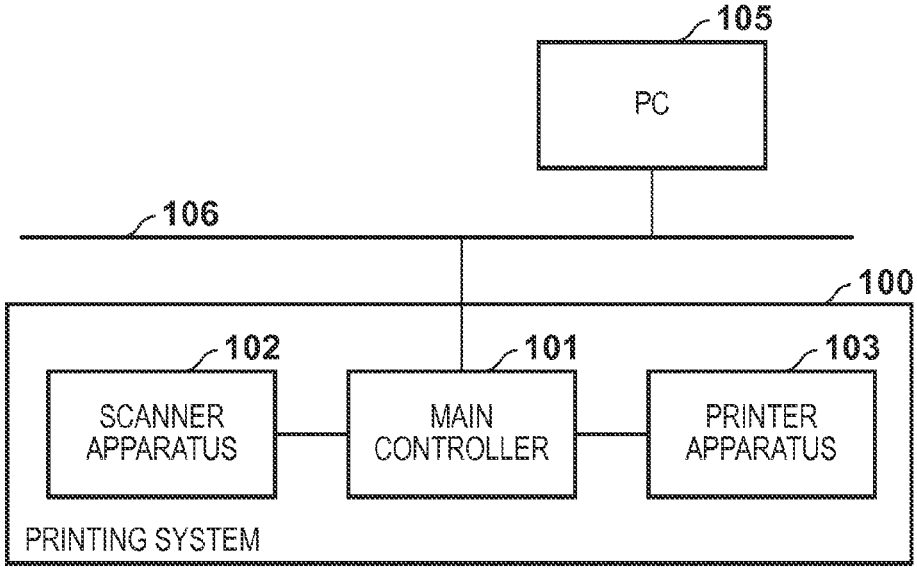
FIG. 1A is a block diagram showing the arrangement of a system according to an embodiment.

FIG. 1A is a block diagram showing the arrangement of a system according to an embodiment.

In FIG. 1A, a printing system 100 includes a main controller 101, scanner apparatus 102, and printer apparatus 103. The main controller 101 mainly performs scheduling control of jobs. The scanner apparatus 102 reads an original and outputs image data corresponding to the image of the original. The printer apparatus 103 prints an image. Details of the printing system 100 will be explained with reference to FIG. 2. The main controller 101 is connected to a PC 105 via a network 106. The PC 105 can input a job to the main controller 101 by using a printer driver (not shown) or the like installed in the PC 105.

Figure 1B:
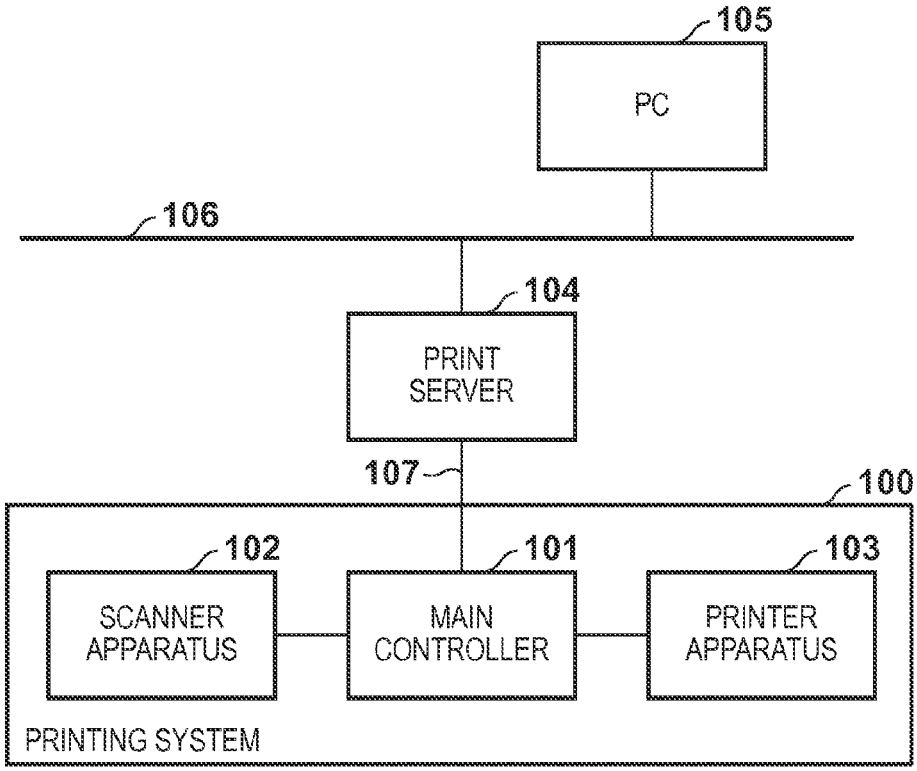
FIG. 1B is a block diagram showing the arrangement of a system according to another aspect of the embodiment.

FIG. 1B is a block diagram showing the arrangement of a system according to another aspect of the embodiment. The same reference numerals as those in FIG. 1A denote the same parts, and a description thereof will not be repeated.

In FIG. 1B, a print server 104 is connected between the PC 105 and the printing system 100. The print server 104 temporarily receives a print job input from the PC 105 connected to the network 106, performs image processing and the like, and then inputs the job to the main controller 101 via a local network 107. At this time, the printing system 100 and print server 104 are seemed as one printing apparatus at once from the network 106.

Figure 2:
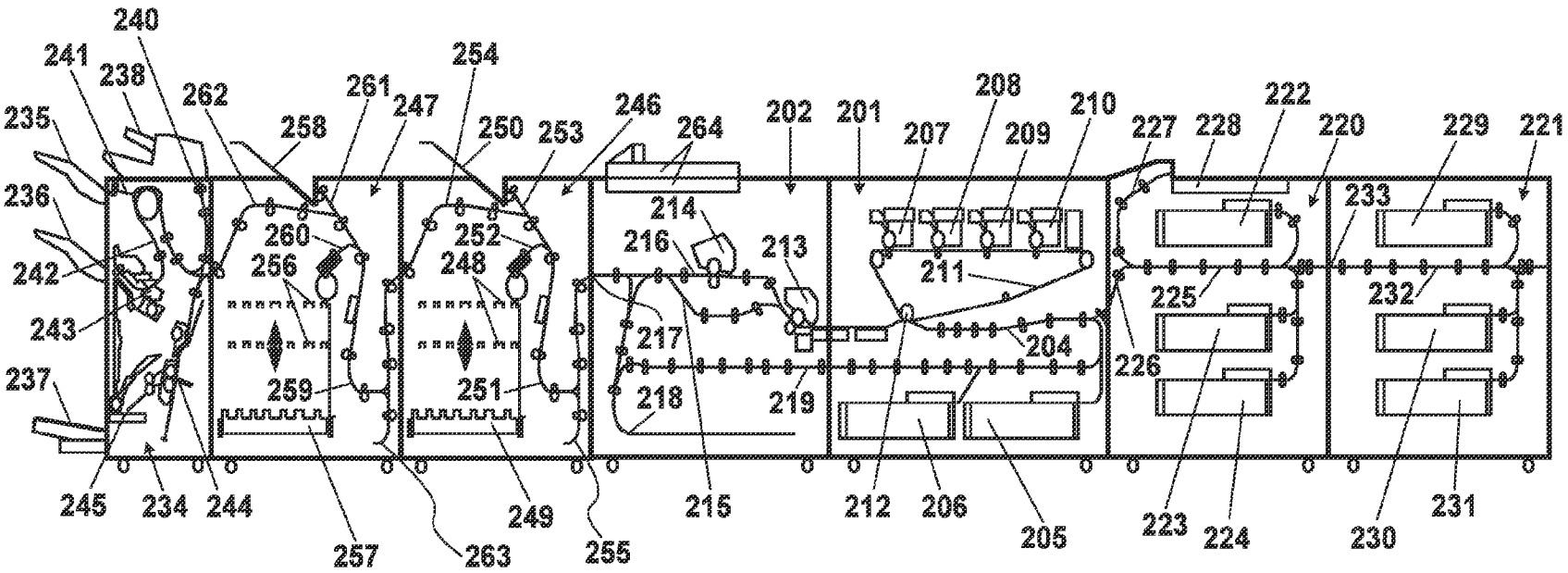
FIG. 2 depicts a sectional view showing the arrangement of the printing system according to the embodiment.

FIG. 2 depicts a sectional view showing the arrangement of the printing system 100 according to the embodiment. The printing system 100 includes the printing apparatus, a sheet feeding accessory apparatus, and post processing apparatuses (large-volume stackers 246 and 247 and a finisher 234).

Reference numeral 201 denotes a main body of the printing apparatus, and reference numeral 202 denotes a fixing apparatus. The main body 201 of the printing apparatus and the fixing apparatus 202 print an image on a sheet. The printer apparatus 103 in FIGS. 1A and 1B is a combination of the main body 201 of the printing apparatus and the fixing apparatus 202. As a sheet feeding apparatus, a large-volume sheet feeding deck 220 is connected to the right side (in FIG. 2) of the main body 201 of the printing apparatus. A plurality of sheet feeding decks are connectable to the main body 201 of the printing apparatus. In FIG. 2, a large-volume sheet feeding deck 221 is further connected to the right side. As a post processing apparatus, the large-volume stacker 246 (stacker a) is connected to the left side of the fixing apparatus 202. A plurality of large-volume stackers 246 are also connectable, and the large-volume stacker 247 (stacker b) is further connected to the left side. Most characteristic control of the post processing apparatuses in the embodiment is control of the large-volume stackers 246 and 247. The finisher 234 is connected to the left side of the large-volume stacker 247.

The main body 201 of the printing apparatus includes sheet feeding decks 205 and 206, which operate as standard sheet feeding units for the printing apparatus. Developing units 207 to 210 include four, Y (yellow), M (Magenta), C (Cyan), and K (Black) stations to form a color image. Images formed by the developing units 207 to 210 are primarily transferred to an intermediate transfer belt 211, forming a color toner image. The intermediate transfer belt 211 rotates clockwise in FIG. 2, and transfers the color toner image at a secondary transfer position 212 to a sheet conveyed through a sheet conveyance path 204. The sheet on which the toner image has been transferred is conveyed from the main body 201 of the printing apparatus to the fixing apparatus 202, and heated and pressurized by a fixing unit 213 of the fixing apparatus 202, thereby fixing the toner image to the sheet. The sheet having passed through the fixing unit 213 is conveyed to a discharge port 217 through a conveyance path 215. For a sheet which needs to be further heated and pressurized to fix the image to the sheet, the sheet having passed through the fixing unit 213 is conveyed to a secondary fixing unit 214 by using the conveyance path, additionally heated and pressurized, and conveyed to the discharge port 217 via a conveyance path 216. When the image forming mode is a double-sided print mode, a sheet is conveyed to a sheet reversing path 218 to reverse the sheet, and fed again through a double-sided feeding path 219. At the secondary transfer position 212, printing is performed on the second one of the two surfaces of the sheet.

Sheets can also be fed from three sheet feeding decks 222, 223, and 224 of the large-volume sheet feeding deck 220, in addition to the standard sheet feeding decks 205 and 206 of the main body 201 of the printing apparatus. Sheets fed from the sheet feeding decks 222, 223, and 224 are conveyed to the main body 201 of the printing apparatus through sheet conveyance paths 225 and 226, and are printed. When the second large-volume sheet feeding deck 221 is connected, sheets can also be fed from three sheet feeding decks 229, 230, and 231. A sheet conveyed through a sheet conveyance path 232 is delivered to the first large-volume sheet feeding deck 220 via a discharge port 233. The large-volume sheet feeding decks 220 and 221 have a function of detecting double feed in which a plurality of sheets are conveyed while overlapping each other. If double feed of sheets is detected, the sheet conveyance path is switched from the normal conveyance path 226 to a conveyance path 227, and the double-fed sheets are discharged to an escape tray 228.

Next, the large-volume stacker 246 serving as a post processing apparatus will be explained.

The large-volume stacker 246 has two discharge designations as sheet output destinations, that is, a discharge tray 250, and a stacking unit including a lift table 248 and ejection table 249. A sheet on which an image is fixed is conveyed from the fixing apparatus 202 to the sheet conveyance portion of the large-volume stacker 246 via the discharge port 217. The sheet is stacked on the lift table 248 of the stacking unit from a conveyance path 251 through a conveyance path 252. In a state in which no sheet bundle is stacked on the lift table 248, the lift table 248 is located at an upper position, as shown in FIG. 2. As stacking of a sheet bundle proceeds, it is controlled to move down the lift table 248 by the height of the stacked sheet bundle so that the top position of the stacked sheet bundle is always at a predetermined level. When stacking of the sheet bundle is completed or the lift table 248 becomes full, the lift table 248 moves down to the position of the ejection table 249. The lift table 248 and ejection table 249 are configured so that bars exist at alternate positions even at the same level. Hence, when the lift table 248 moves down and reaches a position lower than the ejection table 249, the sheet bundle on the lift table 248 is reloaded to the ejection table 249. This operation will be explained in detail with reference to FIGS. 3A to 5F.

When discharging a sheet to the discharge tray 250, the sheet is conveyed from the sheet conveyance path 251 to the discharge tray 250 through a conveyance path 253. Further, when conveying the sheet to a post processing apparatus at the subsequent stage of the large-volume stacker 246, the sheet is conveyed through a sheet conveyance path 254 to the second large-volume stacker 247 or finisher 234.

A reversing unit 255 has a mechanism of reversing a sheet. The reversing unit 255 is controlled so that the facing side of a sheet at the discharge port 217 that is fed into the large-volume stacker 246 basically coincides with the facing side of the sheet at the output destination. When stacking a sheet on the stacking unit, the sheet having passed through the conveyance path 252 is flipped and stacked on the lift table 248. Unless the reversing unit 255 reverses a sheet, the facing side of the sheet becomes different between the discharge port 217 and the lift table 248. To prevent this, when stacking a sheet on the stacking unit, the reversing unit 255 reverses the sheet once so that facing sides of the sheet at the discharge port 217 and on the lift table 248 coincide with each other. When conveying a sheet to the discharge tray 250 or a subsequent post processing apparatus, the sheet is directly discharged at the time of stacking, the facing side of the sheet is the same as that at the discharge port 217, and thus the sheet reversing operation by the reversing unit 255 is not performed. However, as an exception, it can also be controlled to forcibly perform the reversing operation by the reversing unit 255. An escape unit exists at the end of the reversing unit 255. When an abnormal operation such as a jam or error occurs, conveyable sheets can be conveyed to the escape unit as much as possible. Conveyable sheets staying on the right side of the conveyance path of the reversing unit 255 are accumulated in the escape unit at the end of the reversing unit 255.

Note that the arrangement of the second large-volume stacker 247 is the same as that of the above-described large-volume stacker 246. Respective mechanisms 256 to 263 are identical to the mechanisms 248 to 255 of the first large-volume stacker 246, and a description thereof will not be repeated.

Next, the finisher 234 will be explained.

The finisher 234 applies post processing to printed sheets in accordance with a function designated by the user. More specifically, the finisher 234 has functions such as stapling (single or double stapling), punching (two or three holes), and saddle stitching. The finisher 234 includes discharge trays 235 and 236. A sheet is discharged to the discharge tray 235 through a sheet conveyance path 241. On the sheet conveyance path 241, processing such as stapling cannot be performed. When performing processing such as stapling, a sheet is conveyed to a processor 243 through a sheet conveyance path 242, undergoes finishing by a function designated by the user, and then is discharged to the discharge tray 236. The discharge trays 235 and 236 can move up and down. By moving down the discharge tray 235, sheets having undergone finishing processing by the processor 243 can be stacked from a lower discharge port.

When the user designates an insertion sheet, an insertion sheet set in an inserter 238 can be inserted at a predetermined page through a sheet conveyance path 240. When the user designates saddle stitching, sheets are stapled at the center by a saddle stitch processing unit 244, folded in two, and conveyed to a saddle stitching tray 237 through a sheet conveyance path 245. The saddle stitching tray 237 has a belt conveyor structure, and the saddle-stitched bundle stacked on the saddle stitching tray 237 is conveyed to the left side.

Next, a scanner 264 (corresponding to the scanner apparatus 102 in FIGS. 1A and 1B) and a document feeder will be explained in brief.

The scanner 264 is mainly used for the copy function. When setting an original on a platen glass and reading it, the user sets the original on the platen glass and closes the pressing plate of the document feeder. After an opening/closing sensor detects that the pressing plate has been closed, a reflection original size sensor in the housing of the scanner 264 detects the size of the set original. In response to the detection of the size, a light source irradiates the original, and a CCD reads the image of the original. The image signal of the read image is converted into a digital signal, and the digital signal undergoes desired image processing and then is converted into a laser printing signal (image data). The converted image data is stored in the memory of the main controller 101 to be described later.

When setting an original on the document feeder and reading it, the user sets the original on the original setting portion of the document feeder with the original facing up. Then, an original presence/absence sensor detects that the original has been set. In response to this, an original feed roller and conveyance roller rotate to convey the original, and the original is set at a predetermined position on the platen glass. After that, similar to reading of an original set on the platen glass, an image of the original is read and the image data is stored in the memory of the main controller 101.

Next, an ejection operation as a characteristic operation of the large-volume stackers 246 and 247 will be explained.

FIGS. 3A to 3F, 4A to 4F, and 5A to 5F depict views for explaining the operation of the large-volume stacker according to the embodiment. A characteristic operation in the embodiment is a combination operation by the two large-volume stackers 246 and 247. First, a basic operation by one large-volume stacker will be explained.

Figure 3A:
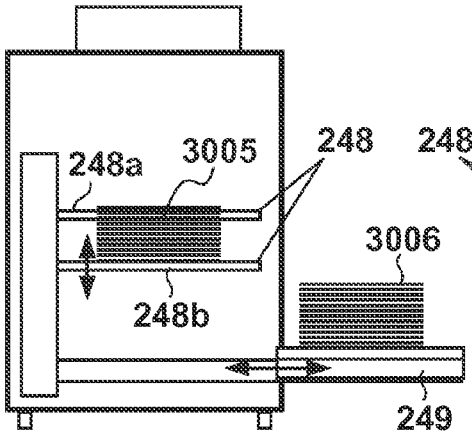
FIGS. 3A to 3F depict views for explaining the operation of a large-volume stacker according to the embodiment.
Figure 3D:
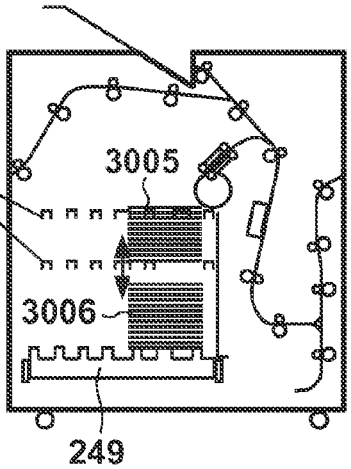
Figure 3B:
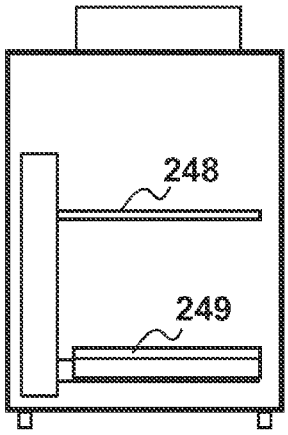
Figure 3E:
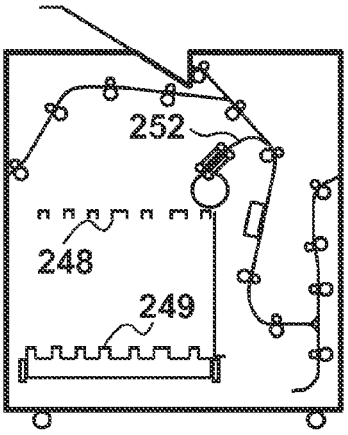
Figure 3C:
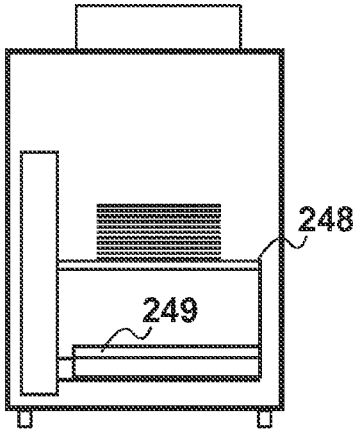
Figure 3F:
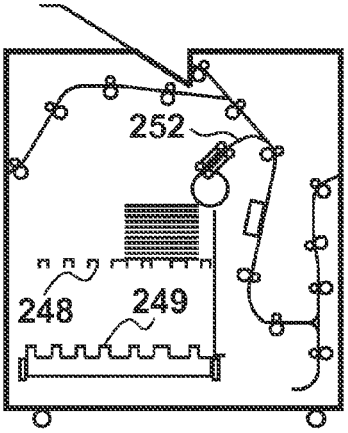

FIGS. 3A to 3C, 4A to 4C, and 5A to 5C depict sectional views showing the large-volume stacker when viewed from the left side in FIG. 2. FIGS. 3D to 3F, 4D to 4F, and 5D to 5F depict sectional views showing the large-volume stacker when viewed from the front in FIG. 2. FIGS. 3A and 3D are views for explaining an outline of the overall large-volume stacker. FIGS. 3B and 3E are views for explaining a state in which the large-volume stacker stands by. FIGS. 3C and 3F are views for explaining a state in which sheets are being stacked on the large-volume stacker.

The lift table 248 is a table for stacking a sheet bundle in the large-volume stacker. In FIGS. 3A and 3D, the lift table 248 is illustrated as if two tables existed, but there is one table in practice. A lift table 248*a* at an upper position represents the position of the lift table 248 when no sheet bundle is stacked. A lift table 248*b* at a lower position represents the position of the lift table 248 when a sheet bundle 3005 is stacked. In the state in which the sheet bundle 3005 is stacked, the lift table 248 moves down to a position where the top of the sheet bundle 3005 becomes flush with the position of the lift table 248*a* when no sheet bundle is stacked. The ejection table 249 is a table for discharging a sheet bundle from the large-volume stacker. When no sheet exists on the ejection table 249, the ejection table 249 is housed in the large-volume stacker. However, when a sheet bundle is reloaded from the lift table 248 and a sheet bundle 3006 is stacked on the ejection table 249, the sheet presence/absence sensor of the ejection table 249 detects that the sheets have been stacked, and the ejection table 249 is ejected (projected) from the stacker.

This operation will be explained in order. FIGS. 3B and 3E show the large-volume stacker in the standby state. Since no sheet bundle is stacked on the lift table 248, the lift table 248 stops at a position (corresponding to 248*a* in FIG. 3A) where it moves uppermost to the position of the discharge port of the sheet conveyance path 252 where a sheet is output to the stacking unit. The ejection table 249 is housed in the stacker.

FIGS. 3C and 3F show a state in which the printing apparatus is executing the print operation, and the large-volume stacker is receiving and stacking sheets discharged from the printing apparatus. As stacking of a sheet bundle on the lift table 248 proceeds, the lift table 248 moves down so that the top of the sheet bundle becomes flush with the position of the discharge port of the stacking unit. Meanwhile, the printing apparatus continuously executes the print operation.

Figure 4A:
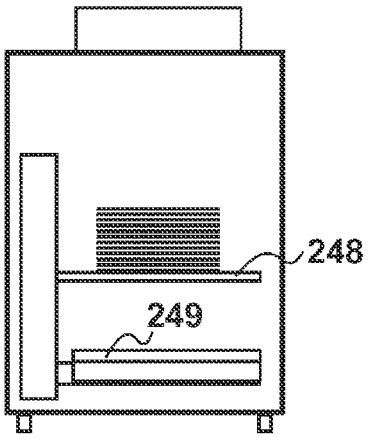
FIGS. 4A to 4F depict views for explaining the operation of the large-volume stacker according to the embodiment.
Figure 4D:
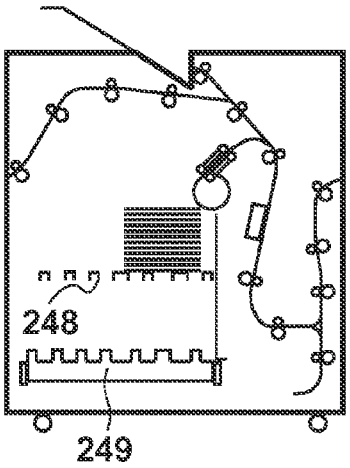
Figure 4B:
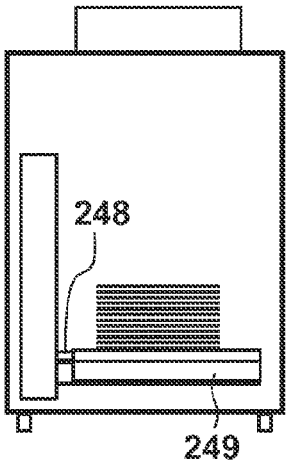
Figure 4E:
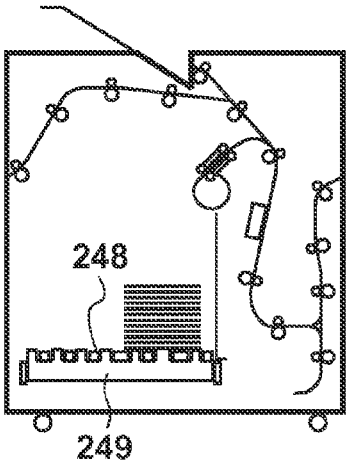
Figure 4C:
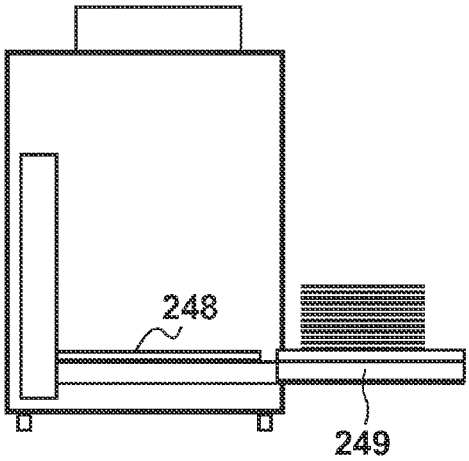
Figure 4F:
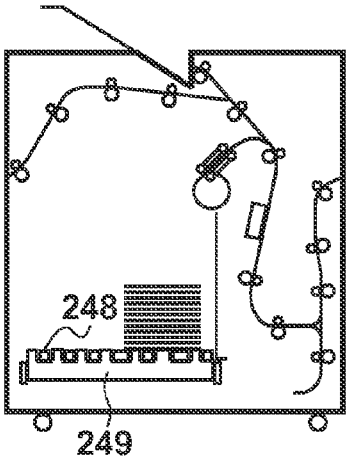

FIGS. 4A and 4D are views for explaining a state upon completion of stacking sheets on the large-volume stacker or a full stacking state. FIGS. 4B and 4E are views for explaining reloading of a sheet bundle from the lift table 248 to the ejection table 249. FIGS. 4C and 4F are views for explaining a state in which the sheet bundle is discharged from the stacker by the ejection table 249.

FIGS. 4A and 4D show a state when stacking of the sheet bundle on the lift table 248 is completed or when full stacking is detected. The timing when stacking of a sheet bundle is completed assumes a case in which it is set to take out the sheet bundle in synchronism with the end of a job. In this state, therefore, the sheet bundle does not always reach the maximum amount stackable on the large-volume stacker. The timing when full stacking is detected means that the sheet bundle reaches the maximum stackable amount and no more sheet can be stacked. In the following description, the completion of stacking of a sheet bundle and full stacking will be referred to as the completion of stacking, unless otherwise specified.

When the large-volume stacker changes to the state shown in FIGS. 4A and 4D, it is determined that the operation of stacking sheets on the lift table 248 cannot be continued any more. Then, the large-volume stacker shifts to a sheet bundle reloading operation as shown in FIGS. 4B and 4E. In this case, the lift table 248 moves down to the position of the ejection table 249. The lift table 248 moves down so that the lift table 248 and ejection table 249 become flush with each other, as shown in FIG. 4E. At this time, the bars of the tables 248 and 249 are located at alternate positions and neither collide nor interfere with each other. When the lift table 248 reaches a position lower than the position of the ejection table 249, the sheet bundle stacked on the lift table 248 is reloaded to the ejection table 249. In this state, the ejection table 249 is ejected from the stacker, and the sheet bundle stacked on the ejection table 249 can be ejected from the stacker, as shown in FIG. 4C.

Figure 5A:
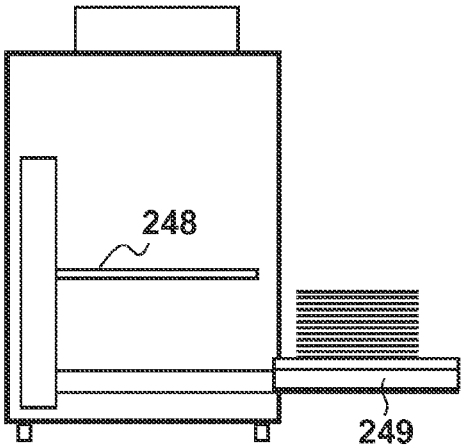
FIGS. 5A to 5F depict views for explaining the operation of the large-volume stacker according to the embodiment.
Figure 5D:
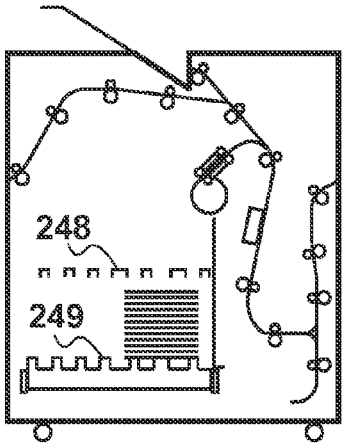
Figure 5B:
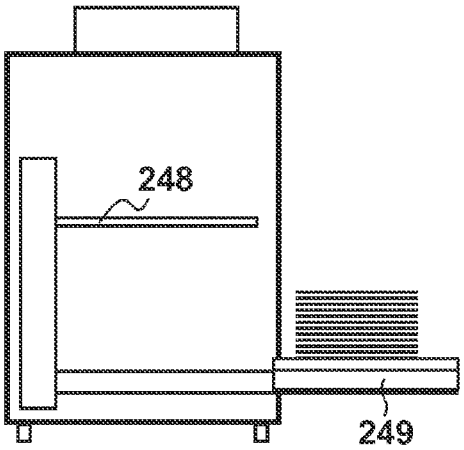
Figure 5E:
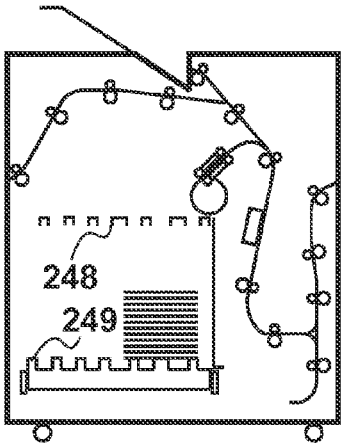
Figure 5C:
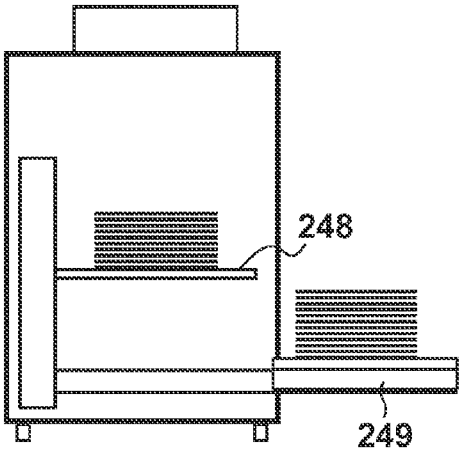
Figure 5F:
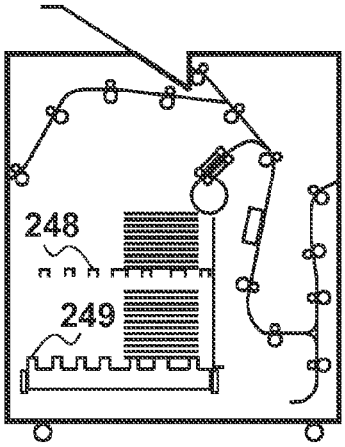

FIGS. 5A and 5D are views for explaining a state in which while the ejection table 249 stays outside the large-volume stacker, the lift table 248 is being returned to the original position. FIGS. 5B and 5E are views for explaining a state in which the lift table 248 returns to the uppermost position and sheets can be stacked. FIGS. 5C and 5F are views for explaining a state in which while the ejection table 249 stays outside the stacker, the next sheet bundle is stacked on the lift table 248.

When the ejection table 249 is ejected from the stacker, as shown in FIG. 4C, the lift table 248 moves up again, as shown in FIGS. 5A and 5D. When the lift table 248 returns to the original position where subsequent sheets can be stacked, as shown in FIGS. 5B and 5E, the printing apparatus restarts the print operation. After then, as the stacking operation of sheets printed by the printing apparatus proceeds, the large-volume stacker changes to the state shown in FIGS. 5C and 5F. Until the large-volume stacker changes from the state shown in FIG. 4A to one shown in FIG. 5B, no sheet can be stacked on the lift table 248, that is, the large-volume stacker can neither receive nor stack printed sheets for almost several tens of seconds. In this manner, when sheets printed by the printing apparatus are stored by using one large-volume stacker, the large-volume stacker cannot receive printed sheets during the sheet bundle reloading operation from the lift table 248 to the ejection table 249. Meanwhile, the print operation by the printing apparatus is interrupted, decreasing the productivity.

Figure 6:
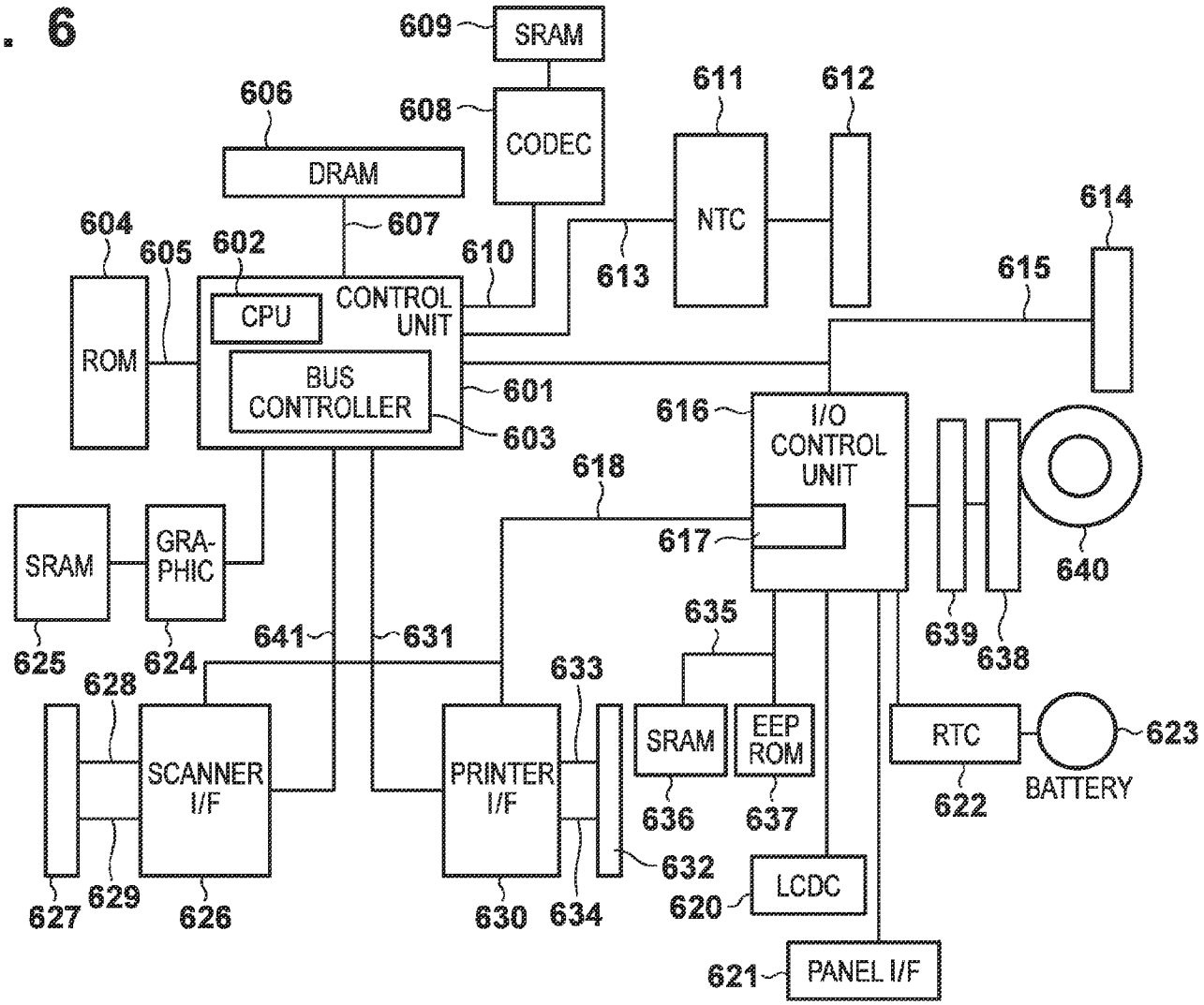
FIG. 6 is a block diagram for explaining the arrangement of the main controller of the printing system according to the embodiment.

FIG. 6 is a block diagram for explaining the arrangement of the main controller 101 of the printing system 100 according to the embodiment.

A control unit 601 mainly includes a CPU 602, bus controller 603, and various interface (I/F) circuits. The CPU 602 and bus controller 603 control the operation of the overall apparatus. The CPU 602 performs a control operation based on a program loaded from a ROM 604 via a ROM I/F 605. This program also describes an operation of interpreting PDL (Page Description Language) code data received from the PC 105 and rasterizing it into raster image data, and is processed by software. The bus controller 603 controls transfer of data input/output from/to each I/F, and performs arbitration on the bus and control of DMA data transfer.

A DRAM 606 is connected to the control unit 601 by a DRAM I/F 607, and is used as a work area by the CPU 602 to operate and an area for accumulating image data. A Codec 608 compresses raster image data accumulated in the DRAM 606 according to a method such as MH/MR/MMR/JBIG/JPEG, and decompresses compressed/accumulated code data into raster image data. An SRAM 609 is used as a temporary work area for the Codec 608. The Codec 608 is connected to the control unit 601 via an I/O 610, and the bus controller 603 controls data transfer between the Codec 608 and the DRAM 606 by DMA.

A graphic processor 624 performs processes such as rotation, scaling, color space conversion, and binarization for raster image data accumulated in the DRAM 606. An SRAM 625 is used as a temporary work area for the graphic processor 624. The graphic processor 624 is connected to the control unit 601 via an I/F, and the bus controller 603 controls data transfer between the graphic processor 624 and the DRAM 606 by DMA. A network controller (NTC) 611 is connected to the control unit 601 via an I/F 613 and to an external network via a connector 612. A general example of the network is an Ethernet.

An expansion connector 614 for connecting an expansion board, and an I/O control unit 616 are connected to a general-purpose high-speed bus 615. A general example of the general-purpose high-speed bus is a PCI bus. The I/O control unit 616 includes asynchronous serial communication controllers 617 of two channels for transmitting/receiving control commands to/from the respective CPUs of the scanner apparatus 102 and printer apparatus 103. The asynchronous serial communication controllers 617 are connected to a scanner I/F circuit 626 and printer I/F circuit 630 via an I/O bus 618.

A panel I/F 621 is connected to a display controller (LCDC) 620, and includes an I/F for presenting a display on a liquid crystal screen on an operation unit, and a key input I/F for accepting inputs from hard keys and touch panel keys.

A real-time clock module (RTC) 622 updates/saves the date and time managed by the printing system 100, and is backed up by a backup battery 623. An E-IDE interface (I/F) 639 is used to connect an external storage. In the embodiment, a hard disk drive 638 is connected via the I/F 639 to store image data in a hard disk 640 and read out image data from the hard disk 640. Connectors 627 and 632 are used to connect the scanner apparatus 102 and printer apparatus 103, and include asynchronous serial I/Fs 628 and 633 and video I/Fs 629 and 634, respectively.

The scanner I/F circuit 626 is connected to the scanner apparatus 102 via the connector 627 and to the control unit 601 via a scanner bus 641. The scanner I/F circuit 626 has a function of performing predetermined processing for image data received from the scanner apparatus 102, and also has a function of outputting, to the scanner bus 641, a control signal generated based on a video control signal sent from the scanner apparatus 102. The bus controller 603 controls data transfer from the scanner bus 641 to the DRAM 606.

The printer I/F circuit 630 is connected to the printer apparatus 103 via the connector 632 and to the control unit 601 via a printer bus 631. The printer I/F circuit 630 performs predetermined processing for image data output from the control unit 601 and outputs the processed image data to the printer apparatus 103. Further, the printer I/F circuit 630 has a function of outputting a control signal sent from the printer apparatus 103 to the printer bus 631. The bus controller 603 controls transfer of raster image data rasterized in the DRAM 606 to the printer apparatus 103, and transfers the raster image data to the printer apparatus 103 via the printer bus 631 and video I/F 634 by DMA.

An SRAM 636 can hold storage contents by using power supplied from the backup battery even when the printing system 100 is turned off. The SRAM 636 is connected to the I/O control unit 616 via a bus 635. An EEPROM 637 is similarly connected to the I/O control unit 616 via the bus 635.

Next, an operation unit for making various settings will be explained.

Figure 7:
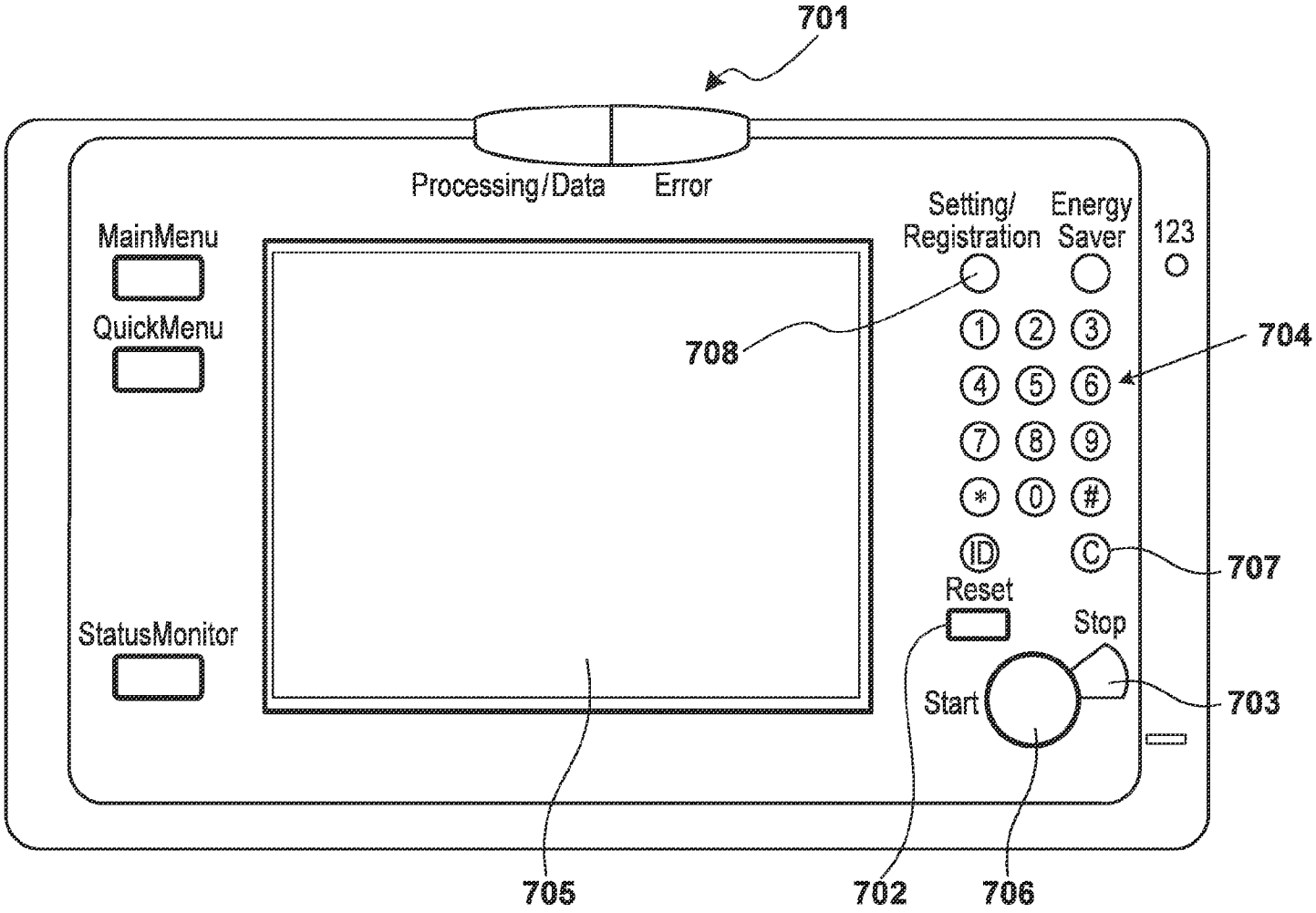
FIG. 7 depicts a plan view showing the arrangement of an operation unit according to the embodiment.

FIG. 7 depicts a plan view showing the arrangement of an operation unit 701 according to the embodiment.

The operation unit 701 includes a liquid crystal display 705, a touch panel adhered to the liquid crystal display 705, and a plurality of hard keys. A signal input from the touch panel or hard key is transferred to the CPU 602 via the panel I/F 621. The liquid crystal display 705 displays image data sent from the panel I/F 621. The liquid crystal display displays functions, image data, and the like in the operation of the printing system 100.

Figure 8:
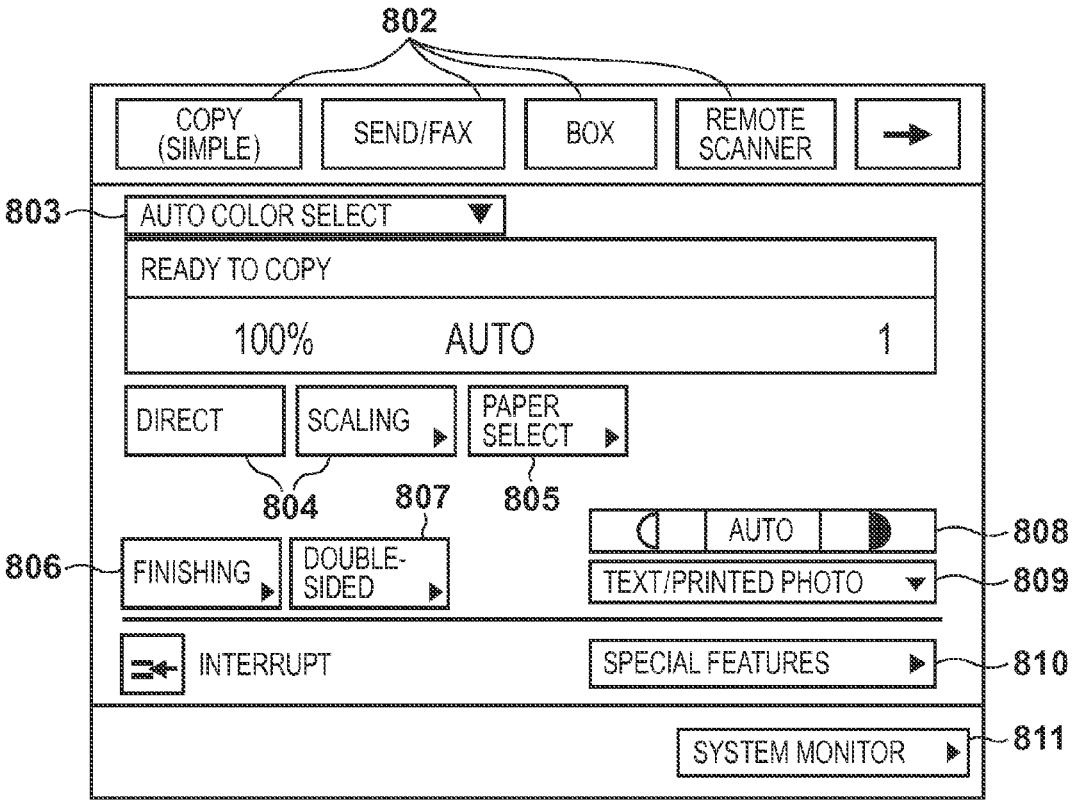
FIG. 8 depicts a view exemplifying a copy setting screen displayed on the liquid crystal display of the operation unit.

A reset key 702 is used to cancel set values and the like set by the user. A stop key 703 is used to stop a running job. A ten-key pad 704 includes keys for inputting a numerical value such as an entry. The liquid crystal display 705 has the touch panel function, and displays various operation screens such as a screen as shown in FIG. 8. This screen provides many touch panel buttons for making various settings. A start key 706 is a key to start a job such as reading of an original by the scanner apparatus 102. A clear key 707 is a key for clearing settings and the like. In addition, the operation unit 701 includes, as hard keys, a setting/registration key 708, a button for saving power, a button for displaying a main menu, a quick menu button which allows each user to customize the screen, and a status monitor button for displaying a device status.

FIG. 8 depicts a view exemplifying a copy setting screen displayed on the liquid crystal display 705 of the operation unit 701.

Tags 802 displayed at the top of the screen are used to select respective functions. In order from left, a "copy" tag designates a copy function, and a "send/FAX" tag designates a transmission function such as FAX transmission, E-mail transmission, and transmission to the file server. A "box" tag designates a box function capable of storing image data read by the scanner apparatus 102 in the hard disk 640 of the main controller 101, and processing and printing data stored in the hard disk 640. A "remote scanner" tag designates a remote scanner function capable of inputting image data scanned by the scanner apparatus 102 to the PC 105 in accordance with an operation from the PC 105 via a network. When the user selects a tag corresponding to each of these functions, the screen shifts to one capable of detailed settings of this function. FIG. 8 exemplifies the screen of the copy function.

A button 803 is used to select a color mode. When the user presses the button 803, a pull-down menu appears to allow him to select one of "color", "monochrome", and "auto". In FIG. 8, "auto" is selected. In addition, there are provided a scaling button 804, a paper select button 805, a finishing button 806 for designating finishing such as shift sort or staple sort, and a double-sided print button 807 for designating double-sided printing. Further, there are provided a bar 808 for designating the density, a button 809 for selecting the type of original, a special feature button 810 for setting various other special features, and a system monitor button 811 for displaying a printing status, the state of consumables, and other statuses.

Details of the setting screen and operation of most characteristic control in the embodiment will be explained with reference to FIGS. 9A and 9B to FIGS. 11A to 11K.

Figure 9A:
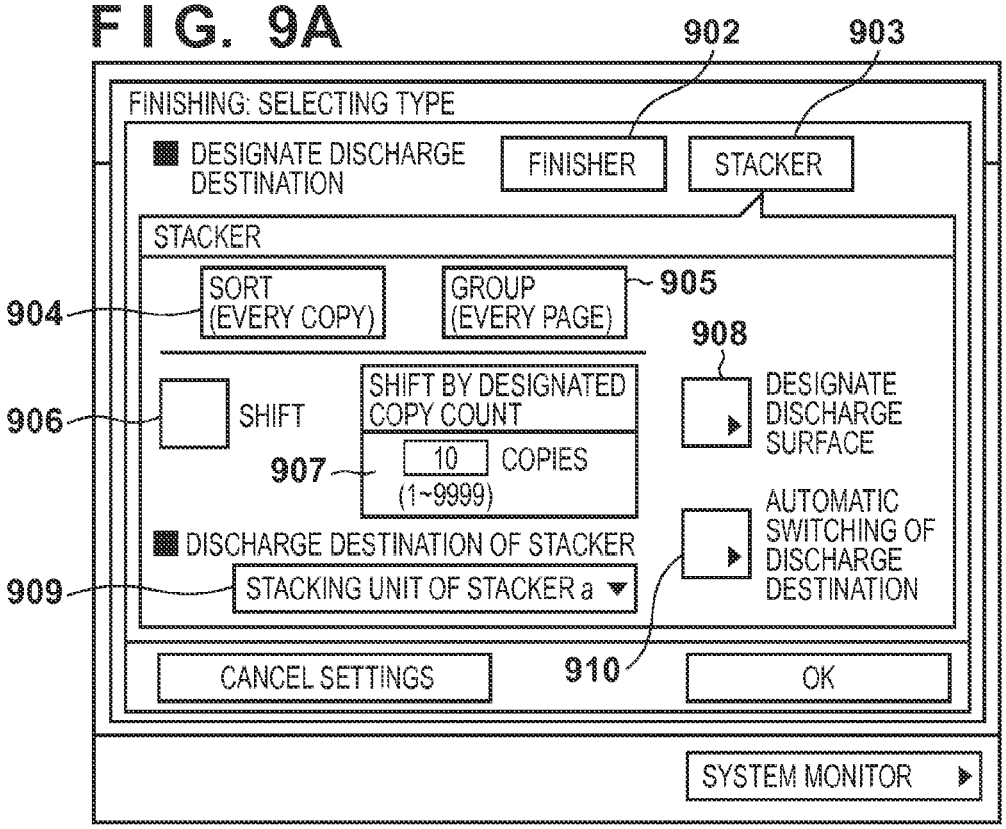
FIG. 9A depicts a view exemplifying a screen displayed on the liquid crystal display of the operation unit when a finishing button 806 in FIG. 8 is pressed.
Figure 9B:
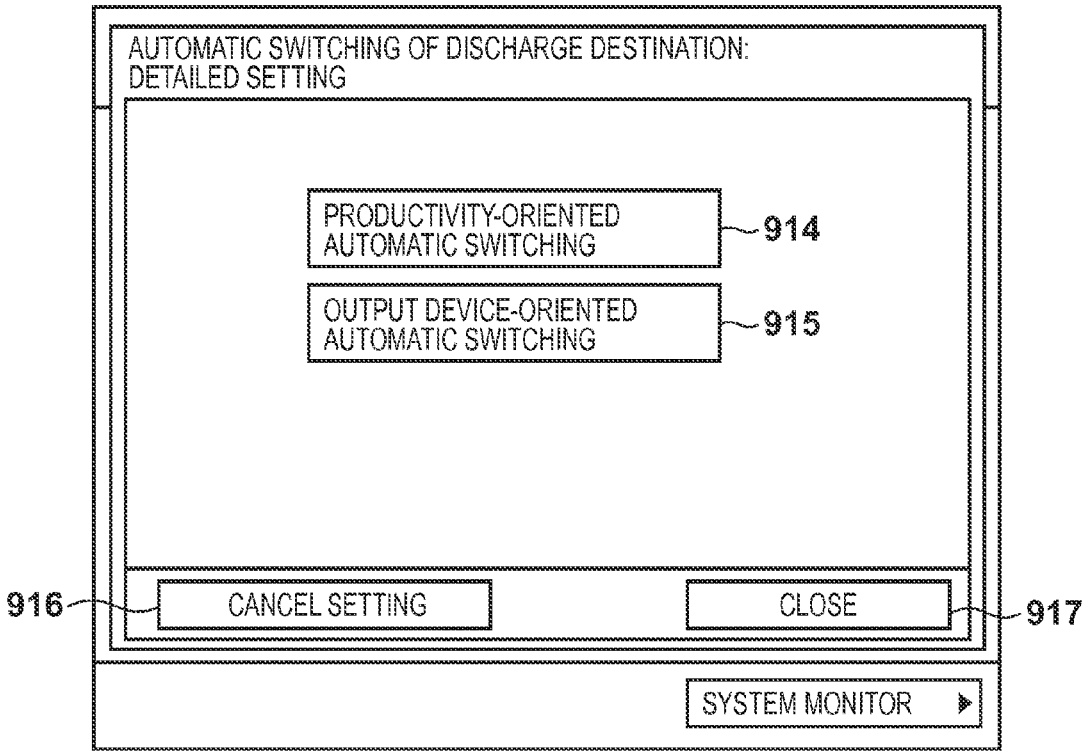
FIG. 9B depicts a view exemplifying a stacker discharge setting screen displayed on the liquid crystal display of the operation unit.

FIGS. 9A and 9B depicts views exemplifying a setting screen displayed on the liquid crystal display 705 of the operation unit 701.

FIG. 9A exemplifies a screen displayed when the finishing button 806 in FIG. 8 is pressed. The screen changes depending on the connection status of post processing apparatuses. FIG. 9A shows a finishing screen in a state in which the two large-volume stackers 246 and 247 and one finisher 234 are connected, as shown in FIG. 2. Buttons 902 and 903 are used to select the finisher or stacker. When the user selects either button, a detailed setting screen as shown in FIG. 9B appears. In FIG. 9B, the stacker is selected upon touching the button 903.

Buttons 904 and 905 are used to select sorting or grouping. A button 906 is used to select whether to perform a shift sort option when the user selects sorting with the button 904. When the user selects shift sort, the user designates, in an input box 907, the number of copies by which the shift operation is performed. For example, when the user wants to shift copies every time 10 copies are output, the user inputs "10" in the input box 907 by using the ten-key pad, as shown in FIG. 9A.

A button 908 is a discharge surface designation setting button, and allows the user to set face-down in which the printed surface of an output sheet faces down, face-up in which the printed surface faces up, and "auto" in which the discharge surface depends on the operation of the device. A button 909 is a pull-down menu for designating the discharge destination of the stacker. The screen shown in FIG. 9A shows a state in which the stacking unit of stacker a (large-volume stacker 246) closer to the printing apparatus is selected in a configuration in which two large-volume stackers are connected. The pull-down menu allows the user to select one of the discharge tray of stacker a, the stacking unit of stacker a, the discharge tray of stacker b (large-volume stacker 247), and the stacking unit of stacker b.

A button 910 is used to set automatically switching the discharge destination. When the button 910 is not selected, if stacking is completed at a discharge destination selected with the button 909, the job is interrupted without switching the discharge destination. When "auto switch" is selected with the button 910, if stacking is completed at the discharge destination of stacker a or b selected with the button 909, it is controlled to automatically switch the discharge destination to the discharge destination of the other stacker and perform a continuous operation. Further, the button 910 allows the user to make a detailed setting of automatic switching of the discharge destination on the screen of FIG. 9B.

A button 915 in FIG. 9B is used to designate the first mode in which automatic switching is performed by giving priority to the output device. A button 914 is used to designate the second mode in which automatic switching is performed by giving priority to the productivity. Details of the productivity- and output device-priority operations will be described with reference to FIGS. 10A to 10J. A setting cancel button 916 is pressed when canceling the setting of automatic switching of the discharge destination that has been made via the screen. A close button 917 is pressed when the detailed setting of automatic switching is completed.

Next, details of the productivity-oriented mode and output device-oriented mode when the discharge destination is automatically switched will be explained with reference to FIGS. 10A to 10J and 11A to 11K.

FIGS. 10A to 10J depict views for explaining the operations of the two large-volume stackers in the productivity-oriented mode according to the embodiment. FIGS. 10A to 10J are views showing the two large-volume stackers when viewed from the side (left side in FIG. 2), and views showing the large-volume stackers when viewed from the front are omitted. To represent an automatic discharge designation switching state, the states of the two large-volume stackers, that is, stacker b (large-volume stacker 247) and stacker a (large-volume stacker 246) are illustrated at the same time.

Figure 10A:
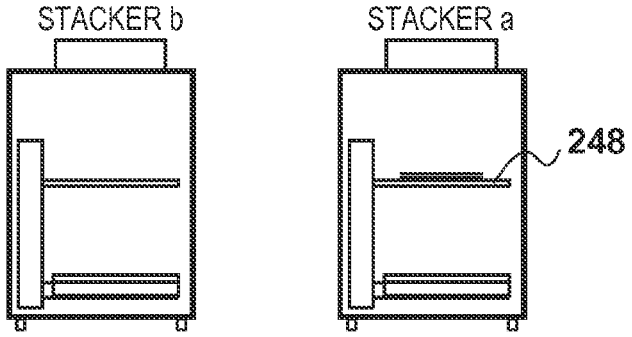
FIGS. 10A to 10J depict views for explaining the operations of two large-volume stackers in the productivity-oriented mode according to the embodiment.

FIG. 10A shows a state in which the print operation starts. At this time, the second stacker b (corresponding to the large-volume stacker 247) stands by, and stacking of sheets on the lift table 248 of the first stacker a (corresponding to the large-volume stacker 246) has started.

Figure 10B:
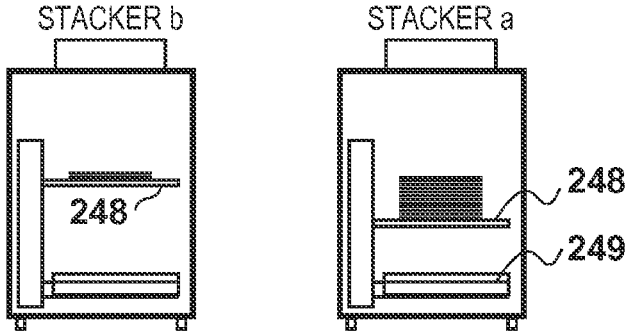

FIG. 10B shows a state in which stacking of a sheet bundle on stacker a proceeds and stacking of the sheet bundle on the lift table 248 of stacker a is completed. Since no more sheets can be stacked on stacker a, stacker a shifts to the operation of reloading the sheet bundle from the lift table 248 to the ejection table 249. Although up/down movement of the lift table 248 takes time, stacking of sheets on the lift table 248 of stacker b starts at this time. That is, it is controlled to perform, in parallel, down movement of the lift table 248 of stacker a and stacking of sheets on the lift table 248 of stacker b.

Figure 10C:
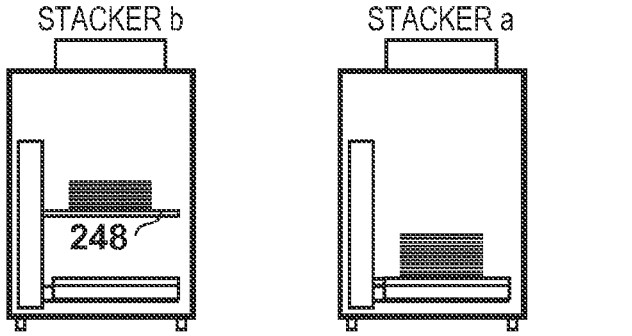

FIG. 10C shows a state in which stacking of sheets on the lift table 248 of stacker b continues while stacker a moves down the lift table 248.

Figure 10D:
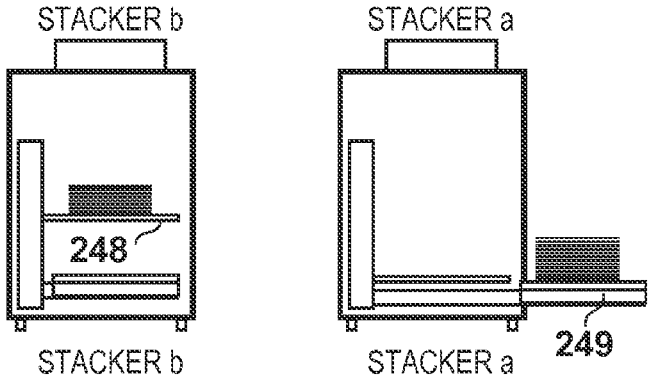

FIG. 10D shows a state in which stacking of sheets on the lift table 248 of stacker b continues while stacker a ejects the ejection table 249.

In this way, the printing apparatus can continue the print operation and store printed sheets on stacker b without the influence of up/down movement of the lift table 248 in stacker a.

Figure 10E:
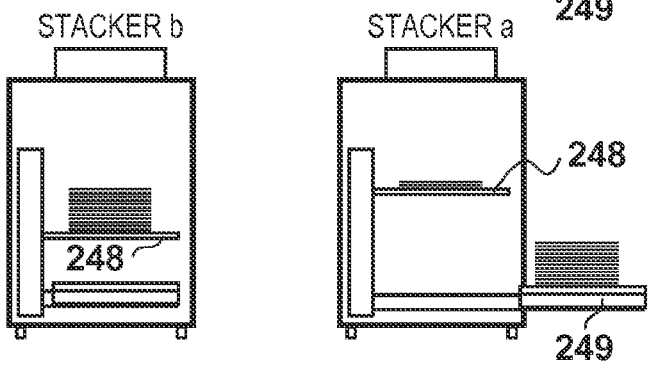

When the print operation continues and stacker b reaches the bundle stacking completion state, the lift table 248 of stacker a has returned to the position where sheets can be stacked next. FIG. 10E shows a state in which stacking of sheets on the lift table 248 of stacker a starts in parallel to down movement of the lift table 248 of stacker b.

Figure 10F:
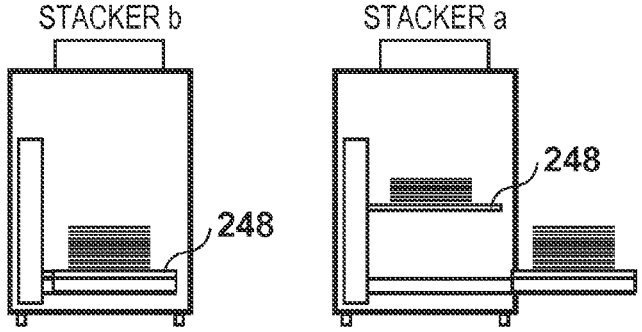

FIG. 10F shows a state in which sheets are stacked on the lift table 248 of stacker a while the lift table 248 of stacker b moves down.

Figure 10G:
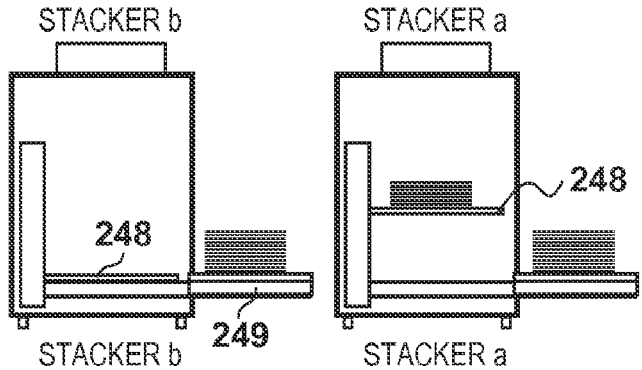

FIG. 10G shows a state in which stacker b ejects the ejection table 249 and stacking of sheets on the lift table 248 of stacker a continues. Since sheet stacking processes are performed in parallel on the two stackers, interruption of print processing in the printing apparatus can be minimized and the printing apparatus can operate by giving priority to the productivity.

Figure 10H:
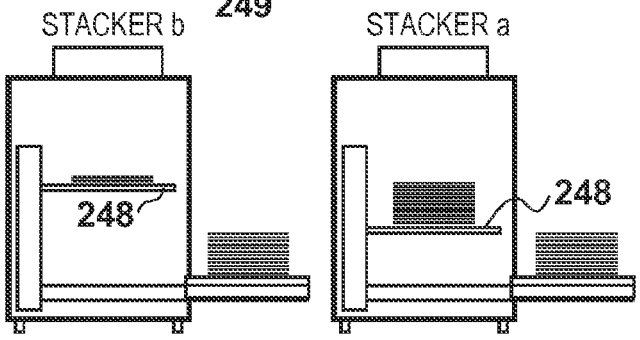

FIG. 10H shows a state in which stacking on the lift table 248 of stacker a is completed. At this time, the lift table 248 of stacker b has returned to the position where subsequent sheets can be stacked. Hence, the discharge destination is switched to stacker b to continuously execute print processing by the printing apparatus.

Figure 10I:
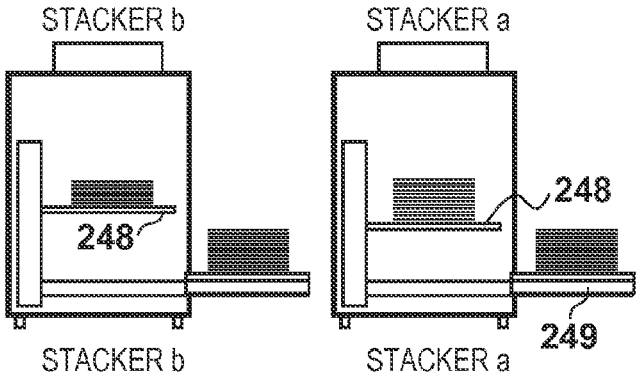

FIG. 10I shows a state in which stacker a cannot stack any more sheets on both the ejection table 249 and lift table 248 and stops the stacking operation, and stacking of sheets on the lift table 248 of stacker b is continuously executed.

Figure 10J:
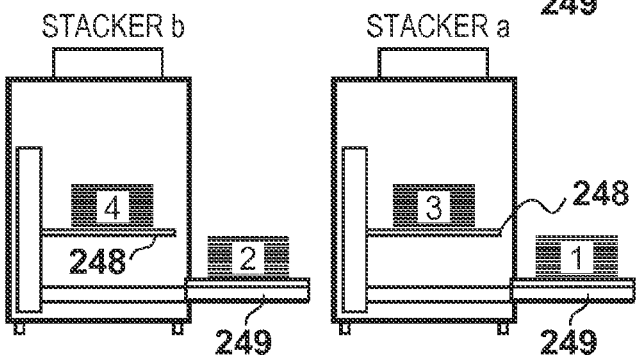

Finally, in FIG. 10J, stacker a cannot stack any more sheets on both the ejection table 249 and lift table 248 and stops, and stacker b also cannot stack any more sheets on both the ejection table 249 and lift table 248 and stops. In this state, neither stacker a nor b can stack sheets, so print processing by the printing apparatus stops. As a result, four sheet bundles are output in the order of stacker a, stacker b, stacker a, and stacker b in the order of numbering stacked sheet bundles in FIG. 10J.

Next, the output device-oriented mode will be explained. In this mode, each large-volume stacker continues the operation without switching the stacker till the completion of stacking on the stacker. The output device-oriented mode has an advantage that the sheet discharge destination is not switched many times and the operator can easily grasp the discharge destination of a sheet bundle he wants, compared to the above-described productivity-oriented mode.

FIGS. 11A to 11K depicts views for explaining the operations of the two large-volume stackers in the output device-oriented mode according to the embodiment. FIGS. 11A to 11K are views showing the two large-volume stackers when viewed from the side (left side in FIG. 2), and views showing the large-volume stackers when viewed from the front are omitted. To represent an automatic discharge designation switching state, the states of the two large-volume stackers, that is, stackers b and a are illustrated at the same time.

Figure 11A:
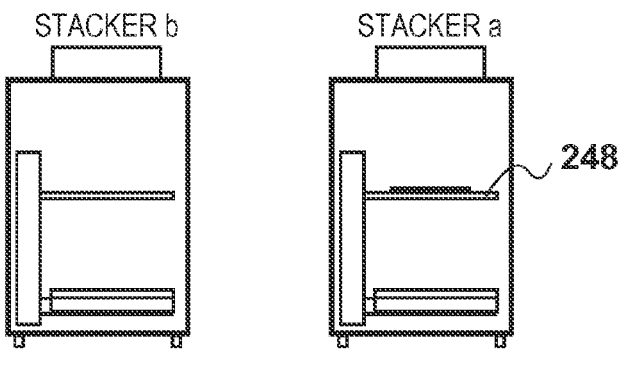
FIGS. 11A to 11K depict views for explaining the operations of the two large-volume stackers in the output device-oriented mode according to the embodiment.

FIG. 11A shows a state in which the print operation starts and stacking of sheets on stacker a starts.

Figure 11B:
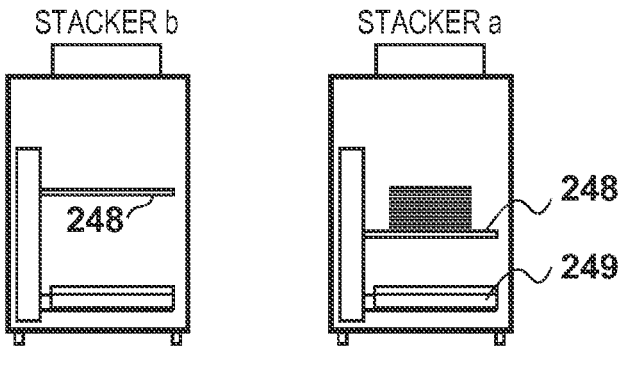

FIG. 11B shows a state in which stacking of sheets on the lift table 248 is completed in stacker a.

Figure 11C:
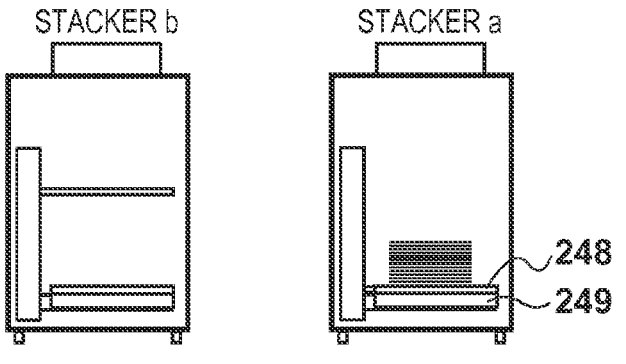

FIG. 11C shows a state in which the lift table 248 moves down in stacker a and the sheet bundle is reloaded to the ejection table 249.

Figure 11D:
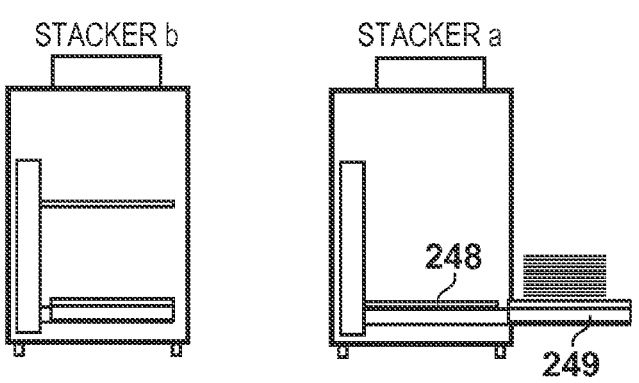

FIG. 11D shows a state in which stacker a ejects the ejection table 249 from it and the stacked sheet bundle can be taken out.

Figure 11E:
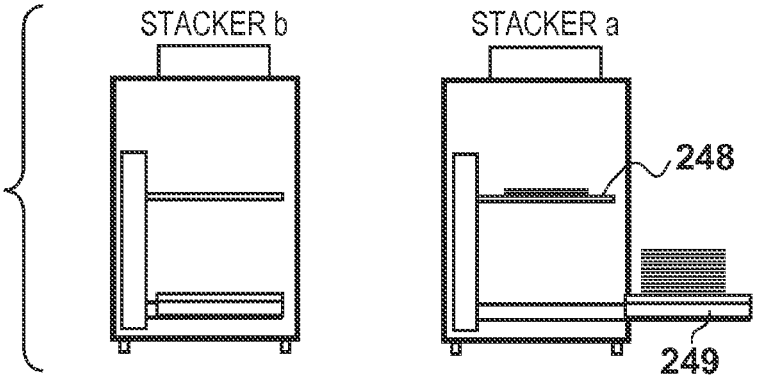

FIG. 11E shows a state in which while stacker a ejects the ejection table 249 from it, the lift table 248 returns to the position where subsequent sheets can be received and stacked, and stacking of subsequent sheets starts. In FIGS. 11B to 11E, the discharge destination of printed sheets is not switched to stacker b, and stacker b stands still. In FIGS. 11B to 11D, stacker a cannot receive printed sheets. Meanwhile, print processing in the printing apparatus stops.

Figure 11F:
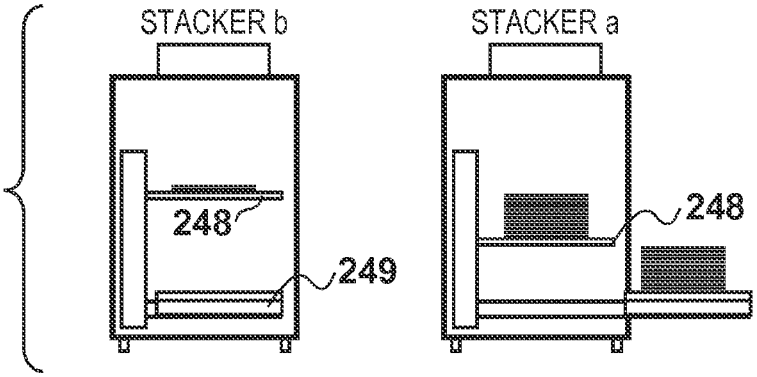

In FIG. 11F, stacking on the lift table 248 of stacker a is completed again. At this time, the tray of stacker a becomes full, and no more sheet can be stacked. Then, the discharge destination of printed sheets is switched to stacker b. After that, stacker a keeps the tray full state and does not operate till the state in FIG. 11K.

Figure 11G:
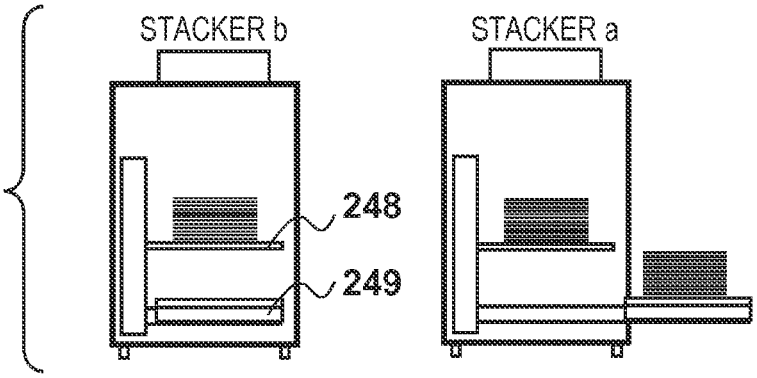

FIG. 11G shows a state in which stacking on the lift table 248 of stacker b is completed.

Figure 11H:
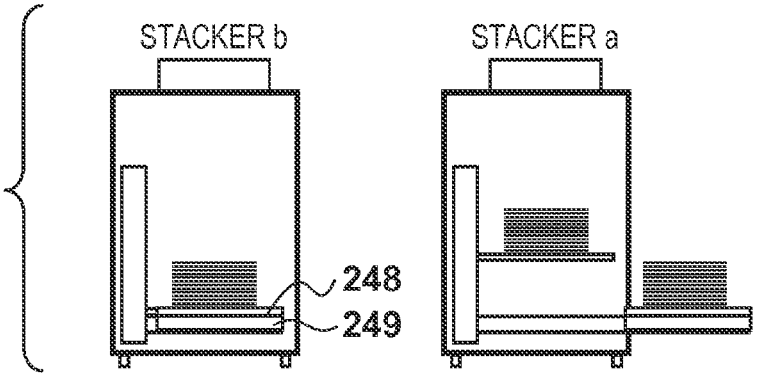

FIG. 11H shows a state in which stacking on the lift table 248 of stacker b is completed, so the lift table 248 moves down to reload a sheet bundle from the lift table 248 to the ejection table 249.

Figure 11I:
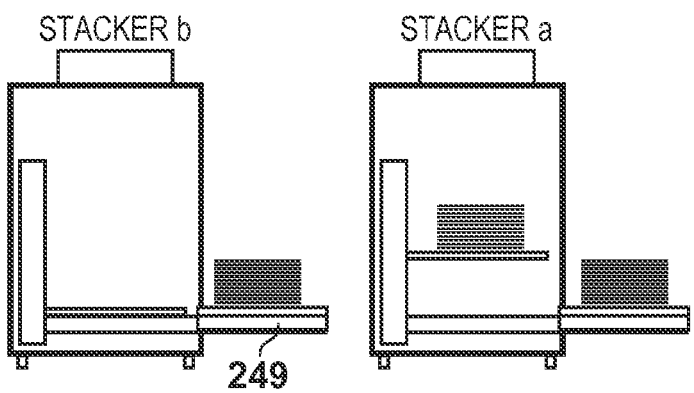

FIG. 11I shows a state in which the ejection table 249 of stacker b is ejected and the sheet bundle can be taken out. In FIGS. 11G to 11I, stacker b cannot receive printed sheets. Meanwhile, print processing in the printing apparatus stops.

Figure 11J:
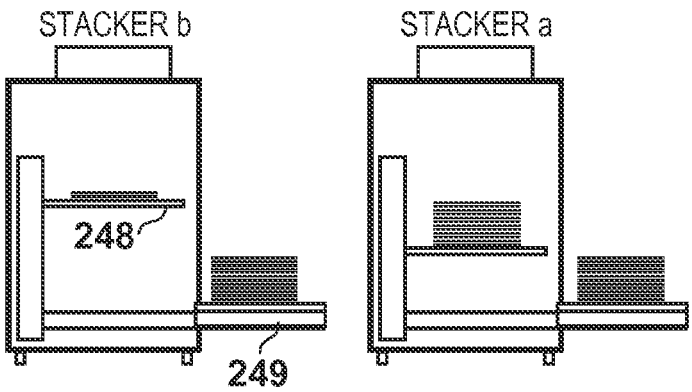

FIG. 11J shows a state in which while stacker b ejects the ejection table 249 from it, the lift table 248 returns again to the position where sheets can be stacked, and the stacking operation of printed sheets conveyed from the printing apparatus restarts.

Figure 11K:
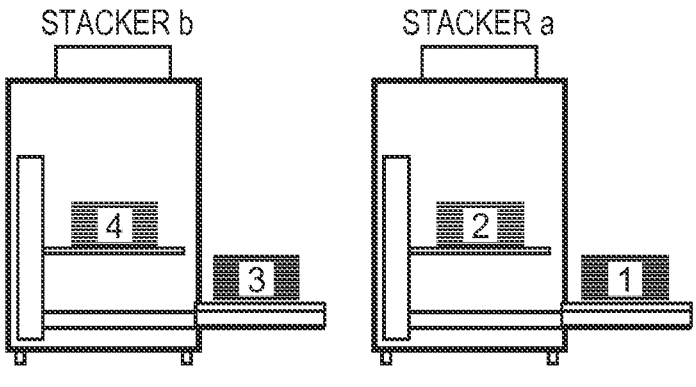

In FIG. 11K, stacking on stacker b is completed, the trays of both two stackers a and b become full, and the operation stops. As a result, four bundles are taken out from stacker a, stacker a, stacker b, and stacker b in the order of numbering stacked sheet bundles in FIG. 11K.

As described above, in the productivity-oriented mode shown in FIGS. 10A to 10J, the printing apparatus does not interrupt print processing until both two stackers a and b cannot stack sheets. Thus, the printing apparatus can operate by giving priority to the productivity. To the contrary, in the output device-oriented mode shown in FIGS. 11A to 11K, until stacking of sheets on both the lift table 248 and ejection table 249 of one stacker is completed, sheets are stacked without switching to the other stacker. When the stacked sheet bundle is reloaded from the lift table 248 to the ejection table 249 in one stacker, print processing by the printing apparatus is interrupted, decreasing the productivity. However, the printed sheet bundles can be taken out first in the order of the ejection table 249 and lift table 248 of one stacker. The remaining sheet bundles can be taken out in the order of the ejection table 249 and lift table 248 of the other stacker. Therefore, the operator can easily grasp the order of printed sheets and the discharge locations of these sheets.

Finally, the flow of control according to the first embodiment will be explained with reference to the flowcharts of FIGS. 12 and 13.

Figure 12:
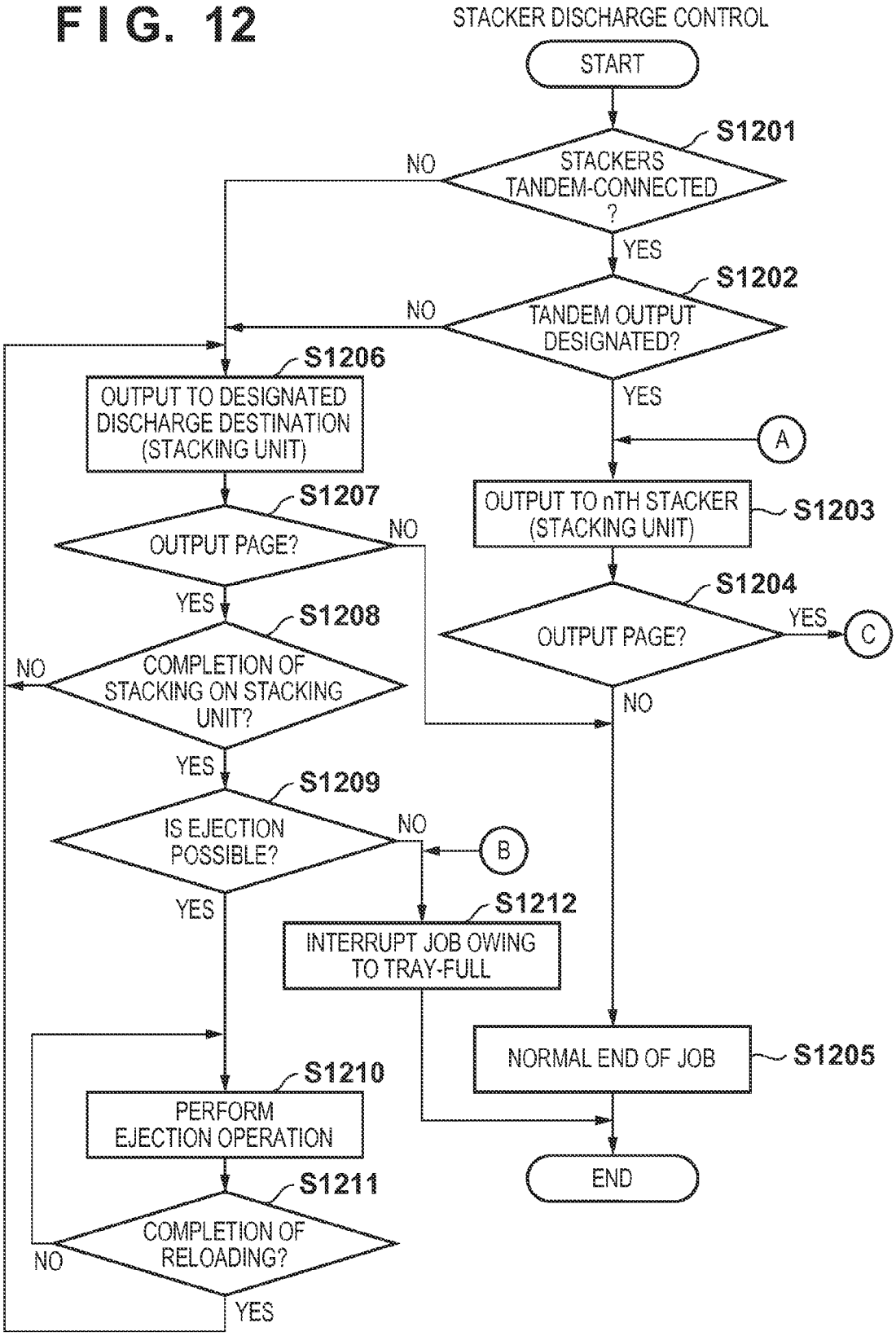
FIG. 12 is a flowchart for describing processing of controlling the discharge destination of printed sheets in the printing system according to the embodiment.
Figure 13:
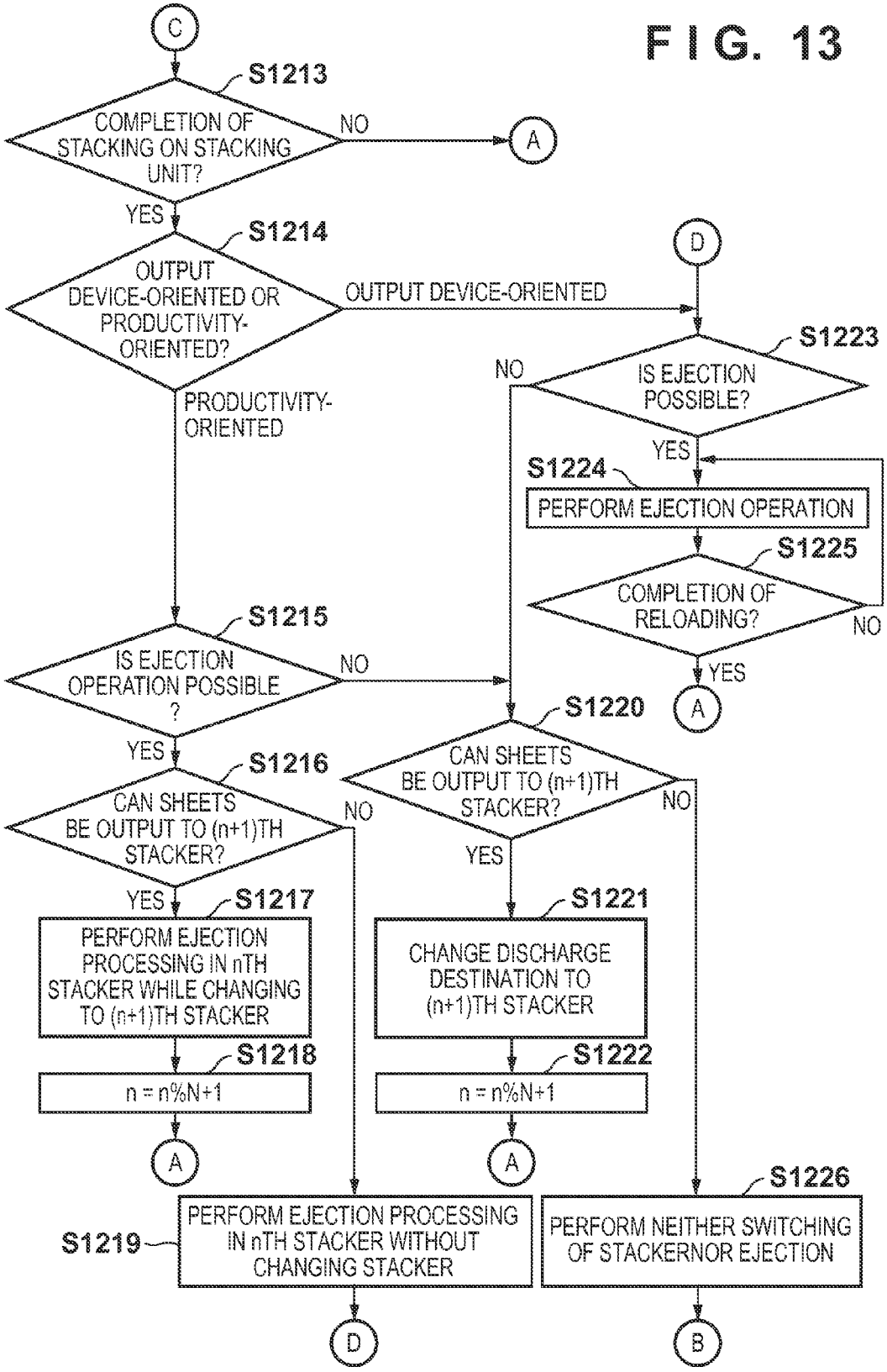
FIG. 13 is a flowchart for describing processing of controlling the discharge destination of printed sheets in the printing system according to the embodiment.

FIGS. 12 and 13 are flowcharts for describing processing of controlling the discharge destination of printed sheets in the printing system according to the embodiment. A program for executing this processing is stored in the ROM 604 of the main controller 101, and executed by the CPU 602, thereby implementing this processing.

First, in step S1201, the CPU 602 determines whether a plurality of large-volume stackers are tandem-connected in the printing system 100. If the CPU 602 determines that large-volume stackers are not tandem-connected, the process advances to step S1206. If the CPU 602 determines in step S1201 that large-volume stackers are tandem-connected, the process advances to step S1202, and the CPU 602 determines whether a tandem output has been designated. If no tandem output is designated, the process advances to step S1206. Processes in step S1206 and subsequent steps pertain to a discharge operation to a single large-volume stacker, and are performed according to the control flow of the operation described with reference to FIGS. 3A to 3F to FIGS. 5A to 5F.

More specifically, in step S1206, the CPU 602 performs a discharge operation to the stacking unit of a designated discharge destination. Then, the process advances to step S1207, and the CPU 602 determines whether there is a page to be output further. If there is no page to be output, the process advances to step S1205, ending the job. If the CPU 602 determines in step S1207 that there is a page to be output, the process advances to step S1208, and the CPU 602 determines whether stacking on the lift table 248 of the stacking unit of the stacker has been completed. If the stacking has not been completed, the process returns to step S1206, and the CPU 602 performs the sheet discharge operation. In step S1207, the CPU 602 determines whether there is a page to be output further. This processing loop is repeated.

If the CPU 602 determines in step S1208 that the stacking has been completed, the process advances to step S1209, and the CPU 602 determines whether the ejection operation in the stacker is possible. That is, the CPU 602 determines whether the sheet bundle reloading operation from the lift table 248 to ejection table 249 of the stacker is possible or whether the ejection table 249 has already been ejected from the stacker. If the CPU 602 determines that ejection is impossible, the process advances to step S1212, and the CPU 602 performs print job interruption processing owing to tray-full, and ends the process.

If the CPU 602 determines in step S1209 that the ejection operation is possible, the process advances to step S1210, and the CPU 602 performs the ejection operation. More specifically, the lift table 248 moves down, a sheet bundle stacked on the lift table 248 is reloaded to the ejection table 249, and then the ejection table 249 is ejected. The process loops between steps S1210 and S1211 till the completion of the sheet bundle reloading operation in step S1211. Upon completion of reloading, the lift table 248 returns again to the stackable position. Thus, the process returns to step S1206 to restart stacking of sheets. In the determination of whether ejection is possible in step S1209, it is basically determined that the second ejection operation after executing the ejection operation once is impossible. However, when the operator removes the sheet bundle on the ejection table 249, the ejection becomes possible again.

Next, processing when a tandem output is designated will be explained. Here, N is the number of tandem-connected stackers. In steps S1218 and S1222 to be described later, a variable n is incremented to take the value of the module N.

If the CPU 602 determines in step S1202 that a tandem output is designated, the process advances to step S1203, and the CPU 602 controls to discharge sheets to the stacking unit of the nth large-volume stacker. Since the variable n is "1" at first, sheets are discharged to the first stacker. Then, the process advances to step S1204, and the CPU 602 determines whether there is a page to be output further. If there is no page to be output, the process advances to step S1205 to perform normal job end processing, and ends. If the CPU 602 determines in step S1204 that there is a page to be output, the process advances to step S1213 (FIG. 13), and the CPU 602 determines whether stacking on the stacking unit has been completed. If the CPU 602 determines that the stacking has not been completed, the process returns to step S1203 (FIG. 12), and loops between the processes in steps S1203 and S1204 to keep outputting a plurality of sheets.

If the CPU 602 determines in step S1213 that the stacking has been completed, the process advances to step S1214, and the CPU 602 determines the detailed setting of the tandem output mode. If the productivity-oriented mode is set, the process advances to step S1215, and the CPU 602 determines whether the ejection operation is possible in a stacker in which the stacking has been completed. If the CPU 602 determines that the ejection operation is possible, the process advances to step S1216, and the CPU 602 determines whether sheets can be discharged to the (n+1)th stacker. In the above-described example, this is equivalent to determination of whether sheets can be output to stacker b when the tray of stacker a becomes full during output. If the CPU 602 determines that sheets can be output to the (n+1)th stacker, the process advances to step S1217, and the CPU 602 switches the discharge destination to the (n+1)th stacker and in parallel executes ejection processing in the nth stacker. This is equivalent to an operation of, upon completion of stacking on the lift table 248 of stacker a, reloading the sheet bundle to the ejection table 249, ejecting the ejection table 249, as shown in FIGS. 10C and 10D. Meanwhile, stacker b receives printed sheets and starts stacking them. The process advances to step S1218, the CPU 602 increments the n value, and then the process advances to step S1203.

If the CPU 602 determines in step S1216 that no sheet can be discharged to the (n+1)th stacker, the process advances to step S1219, and the CPU 602 executes ejection processing of the stacker itself to which sheets are currently output. This is equivalent to a case in which when stacking on the lift table 248 of stacker b is completed in the state of FIG. 10I or 10J, the operator removes a sheet bundle on the ejection table 249 of stacker b. Thereafter, the process advances to step S1223. Since ejection is possible, the process stands by in a loop in which the completion of reloading a sheet bundle from the lift table 248 to the ejection table 249 is waited for in steps S1224 and S1225. If the reloading is completed, the process returns to step S1203 (FIG. 12), and sheets are discharged to the stacker.

If the CPU 602 determines in step S1215 that the ejection operation is impossible, the process advances to step S1220, and the CPU 602 determines whether sheets can be discharged to the (n+1)th stacker. If the CPU 602 determines that sheets can be discharged to the (n+1)th stacker, the process advances to step S1221, and the CPU 602 changes the discharge destination to the (n+1)th stacker. Since no ejection operation can be executed in the nth stacker, no ejection is executed. This is equivalent to a state in which a sheet bundle has already been stacked on the ejection table 249 of the stacker. This corresponds to, for example, the case shown in FIG. 10H. After that, the process advances to step S1222, the CPU 602 increments n, and the process returns to step S1203 (FIG. 12).

If the CPU 602 determines in step S1220 that no sheet can be discharged to the (n+1)th stacker, the process shifts to step S1226. In this state, the discharge destination cannot be switched from the current stacker to the next one (for example, FIG. 10J). Thus, the process advances to step S1212 (FIG. 12) to interrupt the job owing to tray-full of a plurality of stackers.

If the CPU 602 determines in step S1214 that the detailed setting of the tandem output mode is the output device-oriented mode, the process advances to step S1223, and the CPU 602 determines whether the ejection operation is possible in the nth stacker. If the CPU 602 determines that the ejection operation is possible, the process advances to step S1224, and the CPU 602 executes the ejection operation in the current stacker. While the ejection operation, the print processing in the printing apparatus stops. After the CPU 602 determines in step S1225 that reloading has been completed, the print processing is resumed, and the process advances to step S1203 (FIG. 12) to repeat the output operation to the nth stacker. This is equivalent to the operation of stacker a in the output device-oriented mode in FIGS. 11B to 11E and the operation of stacker b in FIGS. 11G to 11J. If the CPU 602 determines in step S1223 that the ejection operation in the nth stacker is impossible, the process advances to step S1220, and the CPU 602 determines whether sheets can be stacked on the next (n+1)th stacker. The state in which it is determined in step S1220 that no sheet can be discharged to the (n+1)th stacker is, for example, the state of FIG. 11K.

The processes when the detailed setting of automatic switching of the discharge destination is the productivity-oriented mode and when it is the output device-oriented mode have been described.

Second Embodiment

The first embodiment has explained an example in which only the two, productivity-oriented mode and output device-oriented mode can be selected as details of automatic switching of the discharge destination. To the contrary, the second embodiment will explain an example in which a finer setting mode can be selected. Note that the arrangement of a printing system and the arrangement of an overall system in the second embodiment are the same as those in the first embodiment, and a description thereof will not be repeated.

For the user, a most desirable operation is an easy-to-understand operation while keeping the productivity high without frequently switching the output destination, as in the output device-oriented mode. From this viewpoint, an intermediate mode is set, in which the operation is performed by taking account of the output device-oriented mode even in the productivity-oriented mode when the time taken to reload a sheet bundle from a lift table 248 to an ejection table 249 is short.

The time taken to reload a sheet bundle from the lift table 248 to the ejection table 249 is the sum of the down movement time (down movement distance) of the lift table 248, the ejection time taken to eject the ejection table 249 from the stacker, and the up movement time (constant) of the lift table 248. Of these times, only the down movement time of the lift table 248 depends on the height of a stacked sheet bundle, and the two latter times are fixed. For this reason, the output device-oriented mode is considered in the productivity-oriented mode in accordance with the varying down movement time of the lift table 248.

Conditions to determine that stacking of a sheet bundle is completed are as follows.

The first condition is that no more sheet can be physically stacked on the lift table 248. In this case, the lift table 248 moves down to a position very close to the ejection table 249. Hence, the time taken to move down the lift table 248 to the position of the ejection table 249 is very short. That is, the time taken for reloading from the lift table 248 to the ejection table 249 may be shortened. In this case, even if the productivity-oriented mode is set, the stacker is switched to operate in the output device-oriented mode.

Second, there are a designated-copy-count stacking function, designated-sheet-count stacking function, and single job stacking function. Even if sheets can be physically stacked on the lift table 248 of the stacker, sheets are handled similarly to the case of tray-full for a specific number of copies, a specific number of sheets, or each job designated by the user. The stacker operates to separate the sheet bundle without continuously stacking any more sheet on the lift table 248. When such logical stacking completion is set, the stacker is highly likely to perform the operation corresponding to physically full stacking before the lift table 248 becomes physically full of stacking. In this case, reloading of the sheet bundle from the lift table 248 to the ejection table 249 is highly likely to be executed while the lift table 248 is located at a position far apart from the position of the ejection table 249. In contrast, when this mode is not set, sheets are stacked on the lift table 248 until the lift table 248 becomes physically full of stacking. Upon completion of stacking the sheet bundle, the lift table 248 is considered to be located at a position near the ejection table 249. Therefore, when not the above-described mode but the productivity-oriented mode is set, it is controlled to switch the stacker to operate in the output device-oriented mode.

Figure 14:
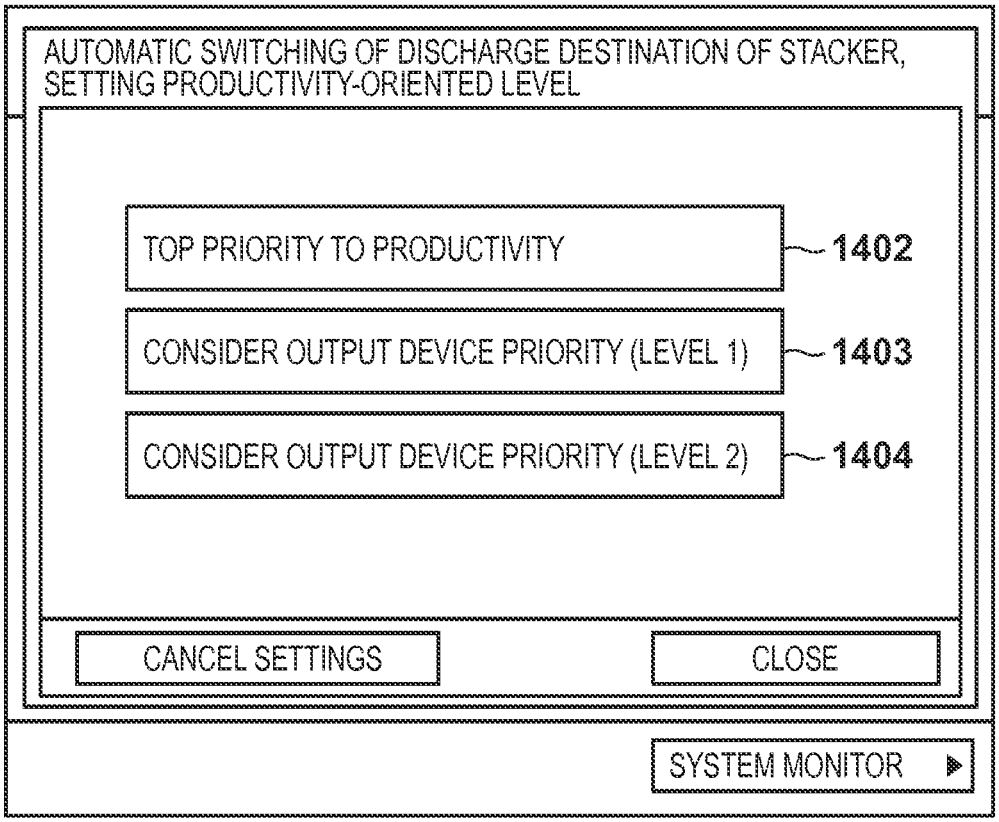
FIG. 14 depicts a view exemplifying an initial setting/registration screen in which a detailed level is set for automatic switching of the discharge destination of a stacker in a printing system according to the second embodiment of the present invention.

FIG. 14 depicts a view exemplifying an initial setting/registration screen in which a detailed level is set for automatic switching of the discharge destination of the stacker in the printing system according to the second embodiment of the present invention. This screen is used to set a detailed level when a print job operates, for which automatic switching of the discharge destination is set with a button 910 in FIG. 9A and a "productivity-oriented automatic switching" 914 in FIG. 9B is selected.

The screen can change to one shown in FIG. 14 by pressing a "Setting/Registration" key 708 in FIG. 7. If the user selects "top priority to productivity" 1402 in FIG. 14, the stacker operates in the productivity-oriented mode described in the first embodiment. If the user selects "consider output device priority (level 1)" 1403, the height of a stacked sheet bundle is detected, as described in the first example. If the detected height is equal to or larger than a predetermined value, it is determined that the lift table 248 has moved down to a predetermined level, and the stacker is switched to operate in the output device-oriented mode.

If the user selects "consider output device priority (level 2)" 1404, it is determined whether the designated-copy-count stacking function, designated-sheet-count stacking function, single job stacking function, or the like has been set, as described in the second example. Even if none of these functions is set, the lift table 248 is considered to be located at a lower position close to the ejection table 249 upon completion of stacking when it is determined that no more sheet can be stacked. Hence, the stacker is switched to operate in the output device-oriented mode.

By performing the above-described control, a mode in which an intermediate operation between the two modes described in the first embodiment is performed can be set.

The second embodiment has the effect capable of minimizing a decrease in productivity while the output device-oriented mode in which the user can easily grasp a sheet bundle can be used as much as possible.

Other Embodiment

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-268808, filed Dec. 7, 2012, which is hereby incorporated by reference herein in its entirety.

What is claimed is:

1. A sheet stacking system for stacking sheets using a first stacking apparatus and a second stacking apparatus, the first stacking apparatus including a lift table and an eject table, the sheet stacking system comprising:

a setting unit configured to set a stacking mode according to a user instruction; and a control unit configured to control, after stacking of a first set of sheets on the lift table is completed, so as to:

(i) in a case that a first stacking mode is set by the setting unit, stack a second set of sheets on the lift table after moving of the first set of sheets from the lift table to the eject table is completed, and stack a third set of sheets on the second stacking apparatus after stacking of the second set of sheets on the lift table is completed, and (ii) in a case that a second stacking mode is set by the setting unit, stack the second set of sheets on the second stacking apparatus while the first set of sheets is being moved from the lift table to the eject table, and stack the third set of sheets on the lift table after stacking of the second set of sheets on the second stacking apparatus is completed.

2. The system according to claim 1, wherein the stacking of the first set of sheets to the lift table is completed when the lift table becomes full with the first set of sheets.

3. The system according to claim 1, wherein the second stacking apparatus includes a lift table and an eject table.

4. The system according to claim 1, wherein the lift table is movable in a vertical direction and the eject table is movable in a horizontal direction.

5. The system according to claim 1, wherein a set of sheets stacked on the lift table has been moved from the lift table to the eject table when the lift table has been moved to a lower position than the eject table in the vertical direction.

6. The system according to claim 1, further comprising a printing unit configured to print images on sheets, wherein the sheets, on which the images have been printed, are stacked by using the first stacking apparatus and the second stacking apparatus.

7. The system according to claim 6, wherein, in a case that the first stacking mode is set by the setting unit, printing by the printing unit is interrupted while the first set of sheets is being moved from the lift table to the eject table.

8. The system according to claim 1, wherein the stacking of the first set of sheets on the lift table is completed when designated copies of sheets are stacked on the lift table.

9. The system according to claim 1, wherein the setting unit is configured to display a setting screen for accepting the user instruction.

10. A method of stacking sheets using a first stacking apparatus and a second stacking apparatus, the first stacking apparatus including a lift table and an eject table, the method comprising:

setting a stacking mode according to a user instruction; and controlling, after stacking of a first set of sheets on the lift table is completed, so as to:

(i) in a case that a first stacking mode is set as the stacking mode, stack a second set of sheets on the lift table after moving of the first set of sheets to the eject table from the lift table is completed, and stack a third set of sheets on the second stacking apparatus after stacking of the second set of sheets on the lift table is completed, and (ii) in a case that a second stacking mode is set as the stacking mode, stack the second set of sheets on the second stacking apparatus while the first set of sheets is being moved to the eject table from the lift table, and stack the third set of sheets on the lift table after stacking of the second set of sheets on the second stacking apparatus is completed.

11. A non-transitory computer-readable storage medium storing a program for causing a computer to execute a method of stacking sheets by using a first stacking apparatus and a second stacking apparatus, the first stacking apparatus including a lift table and an eject table, the program including codes for:

setting a stacking mode according to a user instruction; and controlling, after stacking of a first set of sheets on the lift table is completed, so as to:

(i) in a case that a first stacking mode is set as the stacking mode, stack a second set of sheets on the lift table after moving of the first set of sheets to the eject table from the lift table is completed, and stack a third set of sheets on the second stacking apparatus after stacking of the second set of sheets on the lift table is completed, and (ii) in a case that a second stacking mode is set as the stacking mode, stack the second set of sheets on the second stacking apparatus while the first set of sheets is being moved to the eject table from the lift table, and stack the third set of sheets on the lift table after stacking of the second set of sheets on the second stacking apparatus is completed.

* * * * *